US005517226A

United States Patent [19]

Uehara et al.

[11] Patent Number: 5,517,226

[45] Date of Patent: May 14, 1996

[54] RECORDING APPARATUS WITH SHIFTABLE CONVEYING SYSTEM

[75] Inventors: Tsukasa Uehara, Kawasaki; Kenji Yoshinaga, Tokyo; Kunihiko Matsuzawa, Kawasaki; Seiichiro Adachi, Yokohama; Kazuto Ariga, Tokyo, all of Japan

[73] Assignee: Canon Kabushiki Kaisha, Tokyo, Japan

[21] Appl. No.: 243,527

[22] Filed: May 16, 1994

Related U.S. Application Data

[63] Continuation of Ser. No. 151,050, Nov. 12, 1993, abandoned, which is a continuation of Ser. No. 857,442, Mar. 25, 1992, abandoned.

[30] Foreign Application Priority Data

| | | | |
|---|---|---|---|
| Mar. 28, 1991 | [JP] | Japan | 3-087278 |
| Sep. 11, 1991 | [JP] | Japan | 3-259763 |
| Sep. 11, 1991 | [JP] | Japan | 3-259764 |
| Sep. 11, 1991 | [JP] | Japan | 3-259765 |

[51] Int. Cl.[6] ..... B41J 13/00

[52] U.S. Cl. ..... 347/104

[58] Field of Search ..... 346/134, 68, 145; 347/104, 139, 153, 215, 218, 262, 264; 400/579, 630, 636, 692; 271/273, 274; 355/318

[56] References Cited

U.S. PATENT DOCUMENTS

| | | | |
|---|---|---|---|
| 3,192,534 | 6/1965 | Blakeslee et al. | 346/145 |
| 3,349,702 | 10/1967 | Nesin et al. . | |
| 4,162,843 | 7/1979 | Inoue et al. | 355/4 |
| 4,313,124 | 1/1982 | Hara | 346/140 R |
| 4,345,262 | 8/1982 | Shirato et al. | 346/140 R |
| 4,431,180 | 2/1984 | Nakajima | 271/274 |
| 4,459,600 | 7/1984 | Sato et al. | 346/140 R |
| 4,463,359 | 7/1984 | Ayata et al. | 346/1.1 |
| 4,558,333 | 12/1985 | Sugitani et al. | 346/140 R |
| 4,660,963 | 4/1987 | Stemmle | 355/24 |
| 4,664,501 | 5/1987 | Koizumi et al. | 355/4 |
| 4,723,129 | 2/1988 | Endo et al. | 346/1.1 |
| 4,729,683 | 3/1988 | Zewski | 400/630 |
| 4,740,796 | 4/1988 | Endo et al. | 346/1.1 |
| 4,815,726 | 3/1989 | Pagowski et al. | 271/274 |
| 4,835,567 | 5/1989 | Ogata | 355/318 |
| 4,848,995 | 7/1989 | Sone | 346/145 |
| 4,887,101 | 12/1989 | Hirose et al. | 346/134 |

FOREIGN PATENT DOCUMENTS

| | | |
|---|---|---|
| 54-056847 | 5/1979 | Japan . |
| 59-123670 | 7/1984 | Japan . |
| 59-138461 | 8/1984 | Japan . |
| 60-071260 | 4/1985 | Japan . |
| 62-078577 | 4/1987 | Japan . |
| 62-146876 | 6/1987 | Japan . |
| 2126994 | 4/1984 | United Kingdom . |

*Primary Examiner*—N. Le

*Attorney, Agent, or Firm*—Fitzpatrick, Cella, Harper & Scinto

[57] ABSTRACT

A recording apparatus comprises a recording head for recording an image on a sheet positioned at a predetermined recording position, a conveying device for conveying the sheet so that the sheet passes through the recording position, and a supporting device for supporting the conveying device in such a manner as to shift the conveying device in a first direction transverse to a sheet feeding direction and separating from the recording head and then to shift the conveying device in a second direction in the sheet feeding direction.

18 Claims, 12 Drawing Sheets

RECORDING APPARATUS WITH SHIFTABLE CONVEYING SYSTEM

This application is a continuation of U.S. application Ser. No. 08/151,050 filed Nov. 12, 1993, now abandoned, which is a continuation of U.S. application Ser. No. 07/857,442 filed Mar. 25, 1992, abandoned.

BACKGROUND OF THE INVENTION

1. Field of the Invention

The present invention relates to a recording apparatus such as a word processor, printer and the like, and more particularly, it relates to a recording apparatus wherein the recording is performed by reciprocally shifting a convey member mounted on a recording means in a direction widthwise of a recording medium.

2. Related Background Art

Recently, in recording systems such as word processors, printers and the like, a recording apparatus, wherein a recording medium is intermittently conveyed in a predetermined direction by a convey roller mechanism (conveying means) and an image is recorded on the recording medium by scanning a carriage mounting thereon an ink jet recording head (recording means) in a direction perpendicular to a recording medium feeding direction, has been developed and practically used.

For example, referring to an ink jet printer shown in FIG. 12, a recording sheet 80 is supplied in a direction shown by the arrow A by means of a sheet supply mechanism (not shown) and is fed between feed guides 82*a*, 82*b* supported by a bottom plate 81 of the printer. Then, the recording sheet 80 is fed until it reaches a nip between an auxiliary scanning roller 84*a* and an auxiliary scanning driven roller 84*b* supported by bearing portions 83*a*, 83*b*.

Thereafter, by rotating the auxiliary scanning roller 84*a* and the auxiliary scanning driven roller 84*b*, the recording sheet 80 is directed to a nip between an ejector roller 87*a* and an ejector driven roller 87*b* supported between bearing portions 86*a*, 86*b* while being supported by a platen 85 secured to the bottom plate 81. The auxiliary scanning roller 84*a* and the ejector roller 87*a* are rotated by a driven force from a convey motor 88. The bearing portions 83*a*, 83*b* and the bearing portions 86*a*, 86*b* are formed on left and right side plates 95, 96 uprightly formed on the bottom plate 81, and the auxiliary scanning roller 84*a* and the auxiliary scanning driven roller 84*b*, and the ejector roller 87*a* and the ejector driven roller 87*b* are positioned by the side plates 95, 96.

A recording head 90 mounted on a carriage 89 is disposed above the platen 85, and a timer belt 92 extending between motor pulleys 91*a*, 91*b* is connected to the carriage 89. The motor pulley 91*a* is driven by a main scanning motor 93 to reciprocally shift the carriage 89 along a main scanning rail (guide rail) 94. The recording head 90 has removable ink cartridges (black cartridge 90BK, cyan cartridge 90C, maganta cartridge 90M, yellow cartridge 90Y) including therein ink having four colors, and has a plurality of nozzles extending in directions perpendicular to a shifting direction of the carriage 89, so that the ink is discharged toward the platen 85 in response to image information.

When the carriage 89 scans the recording sheet 80 supported by the platen 85 through the main scanning motor 93, the recording is effected by discharging the ink from the recording head. Whenever one-line recording is finished, the recording sheet 80 is fed by a predetermined amount in the direction A by driving the auxiliary scanning roller 84*a* and the ejector roller 87*a*.

In the above-mentioned recording apparatus, when the recording sheet 80 is jammed by being caught by any constructural element of the apparatus during the feeding of the recording sheet, it is necessary to remove the jammed recording sheet 80. In the past, the jammed sheet was removed by retracting a sheet supply cassette (not shown) and then by pulling the jammed sheet by hand, or by lifting the auxiliary scanning driven roller 84*b* and the ejector driven roller 87*b* upwardly and then by inserting the hand from a downstream side of the sheet feeding direction between the auxiliary scanning roller 84*a* and the auxiliary scanning driven roller 84*b* or between the ejector roller 87*a* and the ejector driven roller 87*b*, thus removing the jammed recording sheet 80.

However, in the above-mentioned jam treatments, there arose the following problems. That is to say, when the recording sheet 80 is jammed after it is supplied from the sheet supply cassette for a small distance, since the operator's hand inserted from the sheet ejecting direction does not reach the jammed recording sheet, the jammed sheet must be removed by retracting the sheet supply cassette from the recording apparatus; however, in so doing, there was concern that a leading end of the jammed sheet would be torn and remain in the apparatus, thus obstructing the further or next sheet supplying operation. Further, when the jam treatment is effected by inserting the operator's hand between the auxiliary scanning roller 84*a* and the auxiliary scanning driven roller 84*b* or between the ejector roller 87*a* and the ejector driven roller 87*b*, there was concern that the operator's finger(s) touched roller surface(s), thus smearing the latter, with the result that, during the next recording operation, the smudge would adhere to the recording sheet 80 to worsen the image quality. Further, since the auxiliary scanning roller 84*a* and the auxiliary scanning driven roller 84*b*, and the ejector roller 87*a* and the ejector driven roller 87*b* are positioned by the bearing portions 83*a*, 83*b* and the bearing portions 86*a*, 86*b* formed in the left and right side walls 95, 96 uprightly formed on the bottom plate 81, respectively, if the jam treatment was effected by lifting the auxiliary scanning driven roller 84*b* and the ejector driven roller 87*b*, there was concern that the positional accuracy of the conveying means with respect to the recording head 90 would be changed after the jam treatment.

In order to solve the above problems, it is necessary to provide various spaces in the apparatus for facilitating the insertion of the operator's hand; however, this results in a large-sized apparatus. Particularly, in a recording apparatus wherein the recording sheet 80 can be supplied from a plurality of overlapped sheet supply cassettes, since it is necessary to insert the operator's hand between the cassettes, there is concern of an inefficient use of space.

SUMMARY OF THE INVENTION

An object of the present invention is to provide a recording apparatus which can eliminate the above-mentioned conventional drawbacks and which makes the jam treatment easier and ensures the safety of the apparatus during the jam treatment.

Another object of the present invention is to provide a recording apparatus which ensures the positional accuracy between a conveying means and a recording means after the jam treatment.

Another object of the present invention is to provide a recording apparatus which can improve the efficiency of the use of space in the apparatus, thus making the apparatus small-sized.

DETAILED DESCRIPTION OF THE PREFERRED EMBODIMENTS

Now, the present invention will be explained with reference to the accompanying drawings, which is applied to a recording apparatus utilizing an ink jet recording system. In this embodiment, an ink jet printer is used as the recording apparatus.

Figure 3:
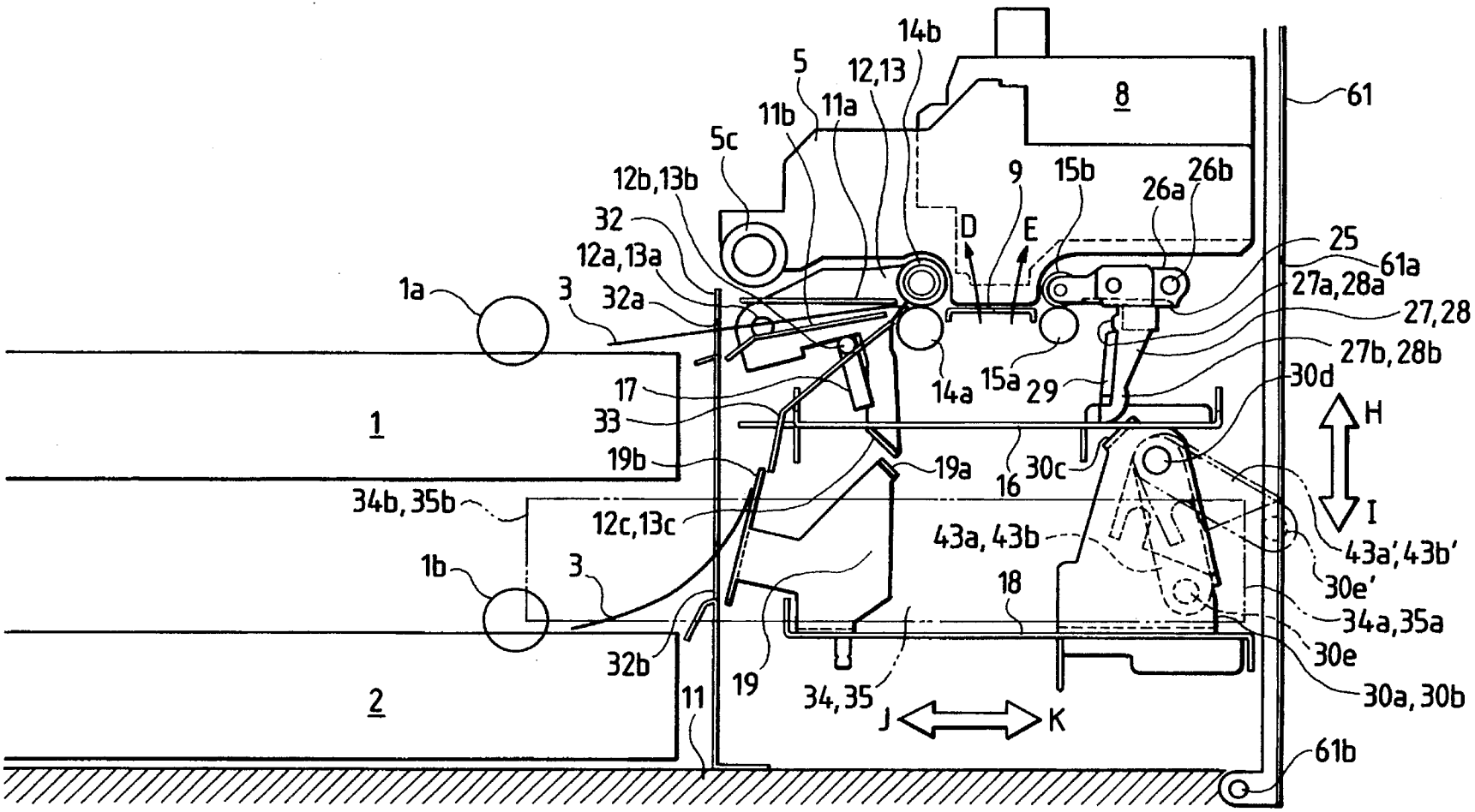
FIG. 3 is a sectional view of the ink jet printer viewed from a direction shown by the arrow G in FIG. 1.

First of all, a schematic construction of the ink jet printer to which the present invention is applied will be explained with reference to FIG. 1. Incidentally, in the ink jet printer according to this embodiment, as shown in FIG. 3, the recording is effected on a recording sheet (recording medium) 3 which can be supplied from overlapped cassettes 1, 2.

Figure 1:
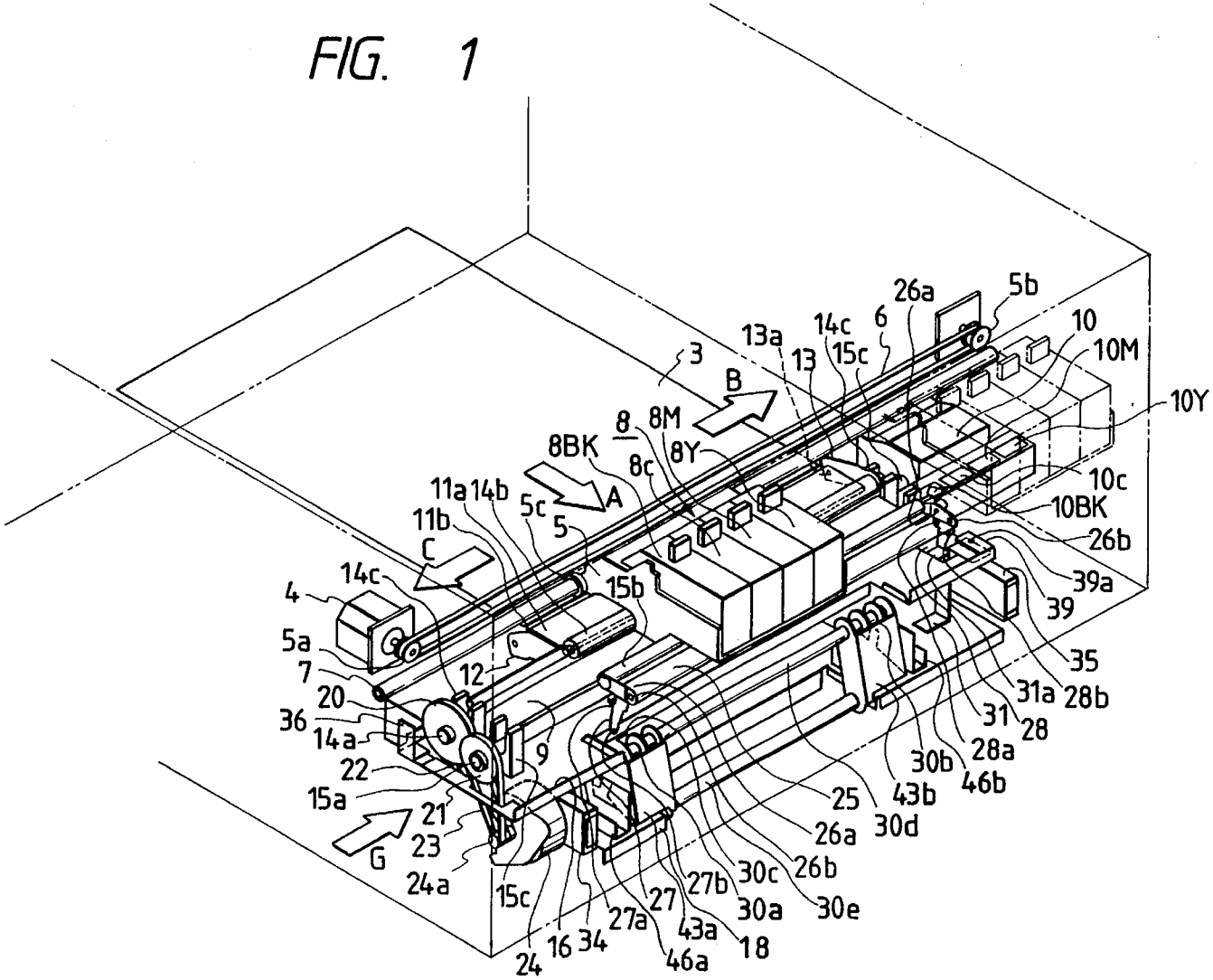
FIG. 1 is a perspective view showing a schematic construction of an ink jet printer.

In FIG. 1, a main scanning motor 4 secured to a chassis (not shown) serves to drive a carriage 5 in directions shown by the arrows B, C. A belt 6 extends between a pulley 5*a* secured to a motor shaft of the main scanning motor 4 and a pulley 5*b* rotatably supported on the chassis (not shown). A main scanning rail 7 acting as a guide rail is supported at its both ends by side walls (not shown) and bearing portions 5*c* of the carriage 5 are fitted on the rail with substantially no play. Further, a portion of the belt 6 is connected to a portion of the carriage 5, so that the carriage 5 can be reciprocally shifted in the directions B, C along the main scanning rail 7 via the belt 6 by rotating the main scanning motor 4.

A recording head 8 is mounted on the carriage 5 and serves to form an image in response to image information. When energy is applied to the recording head 8 in response to a record signal, the recording head discharges ink from its discharge openings. In the illustrated embodiment, among ink jet recording systems, a system having a thermal energy generating means (for example, electrical/thermal converters, laser beams and the like) is particularly used for generating thermal energy as energy utilized to discharge the ink, so that the change in ink condition is caused by such thermal energy. According to this system, high recording density and high recording fineness can be attained.

Further, in this embodiment, the recording head 8 is provided with four ink cartridges having different color ink (cartridge 8BK for black ink, cartridge 8C for cyan ink, cartridge 8M for magenta ink, cartridge 8Y for yellow ink), and each ink cartridge is provided at its lower portion with an array of plural nozzles (not shown) each extending in a direction perpendicular to a shifting direction of the carriage 5, so that the ink can be discharged onto the recording sheet 3 moved on a platen 9 in a direction shown by the arrow A. The nozzles of the recording head 8 are disposed near the recording sheet 3 as possible, in order to improve the target accuracy of the discharged ink droplets onto the recording sheet 3, and are faced to the platen 9 between an auxiliary scanning driven roller 14*b* and an ejector driven roller 15*b* which constitutes a conveying means (described later).

A recovery unit 10 serves to maintain the nozzles of the recording head 8 in the good condition when the carriage 5 is kept at a home position and to perform the recovery operation, and is supported by a bottom plate 11 while being regulated by the side wall (not shown) to which the main scanning rail 7 is attached. The reason why the recovery unit 10 is positioned by the side wall is that it is necessary to accurately align the nozzles of the recording head 8 with recovery openings of the recovery unit and that the accuracy of the relative position between the main scanning rail 7 for guiding the carriage 5 and the recovery unit 10 is improved. The recovery openings are formed in an upper surface of the recovery unit 10 so that they face the corresponding color nozzles (recovery opening 10BK for black color ink nozzles, recovery opening 10C for cyan color ink nozzles, recovery opening 10M for magenta color ink nozzles, recovery opening 10Y for yellow color ink nozzles).

The reference numerals 11*a* and 11*b* denote sheet guides for guiding the recording sheet 3. The recording sheet 3 supplied between the sheet guides 11*a*, 11*b* from the cassette 1 is fed until a leading end of the recording sheet is abutted against a nip between an auxiliary scanning roller 14*a* and the auxiliary scanning driven roller 14*b* which constitute the conveying means. The sheet guides 11*a*, 11*b* have both ends supported by levers 12, 13 which are rotatably received into bearing holes 12*a*, 13*a*, respectively, for pivotal movement in a direction shown by the arrow D in FIG. 3. The reference numerals 14*a*, 14*b* and 15*a*, 15*b* denote the above-mentioned auxiliary scanning roller 14*a* and auxiliary scanning driven roller 14*b* which constitute the conveying means, and the ejector roller and ejector driven roller disposed in parallel with the scanning rollers.

The auxiliary scanning roller 14*a* is rotatably supported in bearing portions 14*c* secured to both ends of the chassis 16, and the auxiliary scanning driven roller 14*b* is rotatably supported by one end of levers 12, 13, which are pivoted around bearing holes 12*a*, 13*a* formed in support plates (not shown) attached to the chassis in the direction D in FIG. 3.

Further, as shown in FIG. 3, the levers 12, 13 are provided with spring holder portions 12*b*, 13*b* and cam portions 12*c*, 13*c*, and tension springs 17 are connected between the spring holder portions 12*b*, 13*b* and the chassis. Thus, the auxiliary scanning driven roller 14*b* is urged against the auxiliary scanning roller 14*a* by elastic forces of the tension springs 17. Further, when the chassis 16 is lowered in a direction shown by the arrow I in FIG. 3 by means of an elevator mechanism (described later), the cam portions 12*c*, 13*c* are abutted against a cam portion 19*a* of a sheet guide 19 secured to a chassis 18. When the chassis 16 is further lowered in the direction I in FIG. 3, the cam portions rotate the levers 12, 13 around the bearing holes 12*a*, 13*a* in the direction D in FIG. 3 in opposition to the elastic forces of the tension springs 17, thus slightly separating the auxiliary scanning driven roller 14*b* from the auxiliary scanning roller 14*a*.

The reference numeral 20 denotes an auxiliary scanning pulley press-fitted on the auxiliary scanning roller 14*a;* and 22 denotes an ejector pulley press-fitted on the ejector roller 15*a*. These pulleys are connected to a motor pulley 24*a* of a convey motor (driving source) 24 via belts 22, 23, respectively.

Further, both ends of the ejector driven roller 15*b* are rotatably supported by bent portions 26*a* of a lever 25. The lever 25 is rotatably mounted on the support plates (not shown) attached to the chassis 16 for pivotal movement around bearing holes 26*b* formed in the bent portions 26*a* in a direction shown by the arrow E in FIG. 3. Levers 27, 28 are attached to the bent portions 26*a*, respectively, which levers 27, 28 are provided with spring holder portions 27*a*, 28*a* and cam portions 27*b*, 27*c*, respectively. As shown in FIG. 3, tension springs 29 are connected between the spring holder portions 27*a*, 28*a* and the chassis 16, so that the ejector driven roller 15*b* is urged against the ejector roller 15*a* by tension forces of the tension springs 29.

Further, when the chassis 16 is lowered in the direction I in FIG. 3 by means of the elevator mechanism (described later), the cam portion 27*b* of the levers 27 is abutted against a cam portion 30*c* of a bearing 30*a* secured to the chassis 18, and the cam portion 28*b* of the lever 28 is abutted against a cam portion 31*a* of an angle 31 secured to the chassis 18. When the chassis 16 is further lowered, the lever 25 is rotated around the bearing holes 26*b* in the direction E in FIG. 3 in opposition to the tension forces of the tension springs 29, thus slightly separating the ejector driven roller 15*b* from the ejector roller 15*a*.

Further, although FIG. 3 shows a condition that the recording sheet 3 can be supplied from the upper and lower cassettes 1, 2, the recording sheets 3 are not supplied from both cassettes simultaneously. The reference numeral 32 denotes a partition plate for isolating the sheet supply cassettes 1, 2 from the conveying means for the recording sheet 3, which partition plate is secured to the bottom plate 11. The partition plate 32 is provided with windows 32*a*, 32*b* for permitting the passage of the recording sheets 3 supplied from the cassettes 1, 2, respectively. Further, the recording sheet 3 supplied from the cassette 2 is guided by a guide portion 19*b* of the sheet guide 19 shiftable together with the chassis 18 in a direction shown by the arrow K, and then is guided by a sheet guide 33 both ends of which are supported by the levers 12, 13, so that the recording sheet is directed between the auxiliary scanning roller 14*a* and the auxiliary scanning driven roller 14*b*.

Further, the reference numeral 61 denotes an ejection door constituting a part of an outer frame of the printer. The recording sheet 3 after being recorded is ejected onto an ejection tray (not shown) attached to the ejection door 61 through the window 61*a*. The ejection door 61 is pivotally connected to the bottom plate 11 by means of hinges (not shown) for pivotal movement around holes 61*b*. In the recording condition, as shown in FIG. 3, an ejecting portion of the printer is closed, whereas, when the jam treatment is effected, the ejecting portion of the printer is opened so that the chassis 18 can be retracted.

The recording sheet 3 supplied from either the cassette 1 or the cassette 2 by means of a sheet supply roller 1*a* or 1*b* is pinched between the auxiliary scanning roller 14*a* and the auxiliary scanning driven roller 14*b* and is conveyed by them. When the leading end of the recording sheet 3 reaches a recording area of the platen 9, the auxiliary scanning roller 14*a* is stopped, and the carriage 5 is reciprocally shifted along the main scanning rail 7 in the direction perpendicular to the sheet feeding direction. While the carriage is being shifted, the four color inks are discharged from the recording head 8, thus recording an image on the recording sheet 3. The recording is effected by a predetermined length along the sheet feeding direction whenever the recording head 8 is scanned once, and, whenever the recording regarding each scanning operation is finished, the recording sheet is conveyed by a predetermined amount by means of the auxiliary scanning roller 14*a*. By alternatively repeating the recording of the predetermined length and the conveyance of the recording sheet of the predetermined length, it is possible to record the images through substantially the whole area of the recording sheet.

The recording sheets having different sizes are loaded in the cassettes 1, 2. When the recording sheets are used up, the cassette 1 or 2 is retracted in a direction opposite to a direction shown by the arrow G in FIG. 1, and new recording sheets are replenished therein. Thereafter, the cassette is inserted in the direction G.

Figure 2:
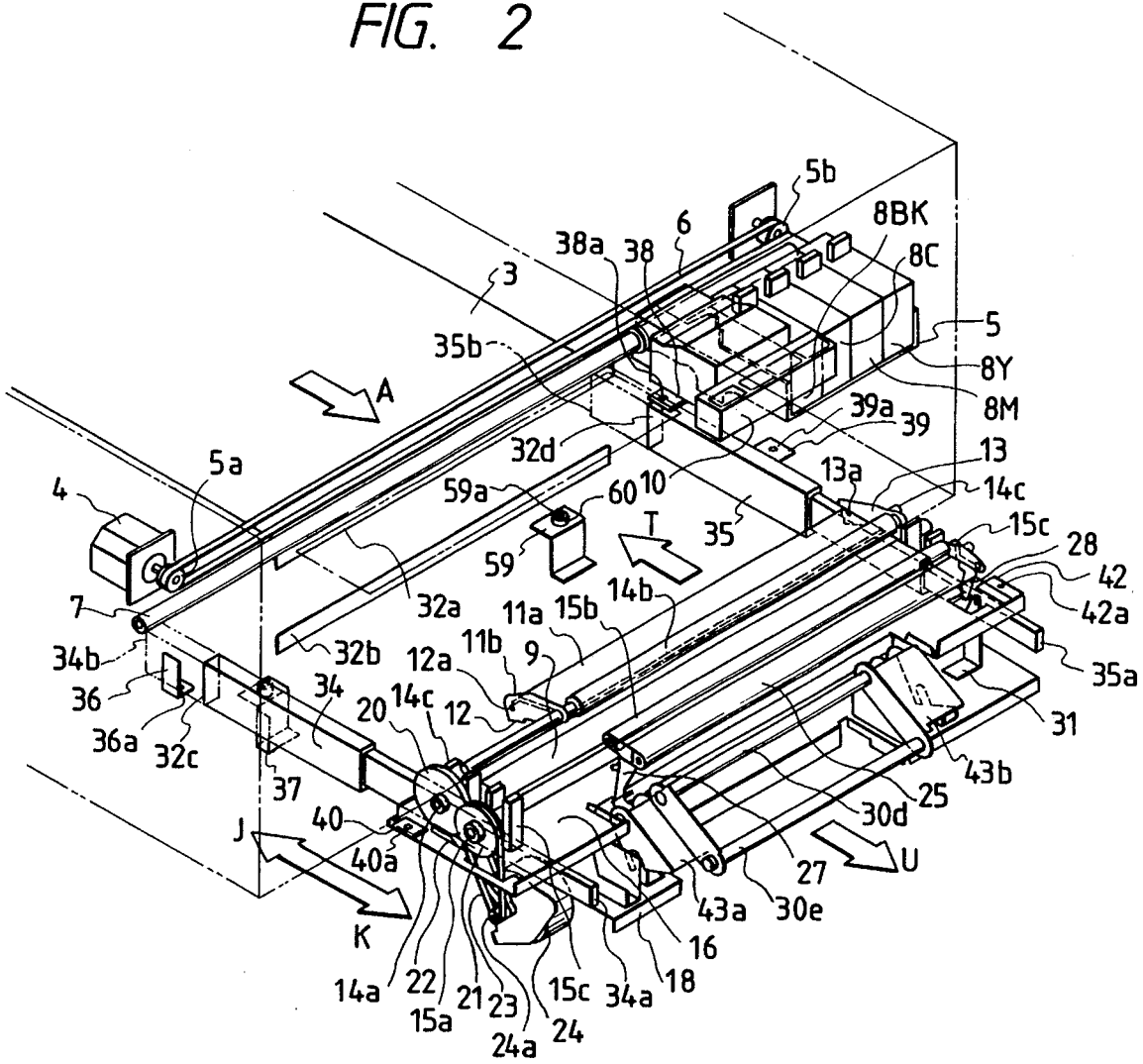
FIG. 2 is a perspective view of the ink jet printer for explaining the jam treatment operation.

In FIG. 2, the reference numerals 34 and 35 denote slide rails supported by the bottom plate 11 via a supporting mechanism (not shown) and capable of permitting the shifting movement of the chassis 18 in directions shown by the arrows J and K. The slide rails 34, 35 are extended toward the cassettes 1, 2 through holes 32*c*, 32*d* formed in a partition plate 32, as shown in FIG. 3. If the lengths of the slide rails 34, 35 are selected so that they do not protrude toward the cassettes 1, 2, as shown in FIG. 3, a stroke for retracting the chassis 18 in the direction K for the jam treatment will be shorter or insufficient, thus making the jam treatment difficult. Further, if the slide rails 34, 35 are arranged outside the partition plate 32, front ends 34*a*, 35*a* of the rails will be protruded rightwardly (FIG. 3), thus making the apparatus large-sized. Thus, as mentioned above, rear ends 34*b*, 35*b* of the slide rails 34, 35 are extended toward the cassettes 1, 2.

Further, regarding the heights of the slide rails 34, 35, as shown in FIG. 3, they are disposed between the upper cassette 1 and the lower cassette 2 for the following reasons.

(1) Since it is necessary to provide sheet supply mechanisms (not shown) for supplying the recording sheets 3 from the cassettes 1, 2, and, particularly, since the sheet supply mechanism for the cassette 2 must be arranged between the cassettes 1 and 2, there is a space between the cassettes regardless the presence of the slide rails 34, 35. Accordingly, by arranging the slide rails in this space, the space can be utilized more effectively.

(2) If the slide rails 34, 35 are arranged above the cassette 1, it is feared that they interfere with the scanning movement of the carriage 5.

(3) If the slide rails 34, 35 are arranged at the same height as the cassette 1 or cassette 2, in order to avoid the interference with the cassettes, the slide rail 34 must be arranged at this side (FIG. 3) regarding the cassettes and the slide rail 35 must be arranged at the other side of the cassettes, with the result that the dimensions of the apparatus in the directions B and C in FIG. 1 will be increased. Further, when the mounting direction for the cassettes 1, 2 coincides with the direction G in FIG. 1, if the slide rails 34, 35 are arranged at the same height as the cassette 1 or cassette 2, cassettes 1, 2 cannot be inserted or retracted along such direction.

Accordingly, by arranging the slide rails 34, 35 between the upper cassette 1 and the lower cassette 2, since the space obtained after the chassis 18 is retracted can be used as the space for the jam treatment, the space can be utilized more efficiently, thus permitting the compactness of the apparatus.

Incidentally, in FIGS. 1 and 2, the reference numerals 36, 37, 38 and 39 denote positioning plates constituting a positioning means when the chassis 16 is lifted (i.e., shifted in a direction shown by the arrow H in FIG. 3). The positioning plates 36, 38, 39 have downwardly (direction I in FIG. 3) directed positioning pins 36*a*, 38*a*, 39*a*, respectively. These positioning pins 36*a*, 38*a*, 39*a* are adapted to be received in holes formed in positioning guides 40, 41, 42 attached to the chassis 16, respectively. That is to say, the positioning pin 36*a* can be received in the hole 40*a* of the positioning guide 40, the positioning pin 38*a* can be received in the hole 41*a* (not shown) of the positioning guide 41, and the positioning pin 39*a* can be received in the hole 42*a* of the positioning guide 42.

The fitting relation between the positioning pin 36*a* and the positioning hole 40*a* is selected to be relatively close; the fitting relation between the positioning pin 38*a* and the positioning hole 41*a* is selected to be close in the directions J, K and be loose in the directions B, C in FIG. 1; and the fitting relation between the positioning pin 39*a* and the positioning hole 42*a* is selected to be loose. By fitting the positioning pins into the corresponding positioning holes, the chassis 16 is positioned in the directions B, C in FIG. 1 and in the directions J, K in FIG. 3. Further, the positioning of the chassis 16 in the height direction (direction H in FIG. 3) is effected by abutting the guides 40, 41, 42 against the positioning plates 36, 38, 39, respectively, and by abutting the chassis 16 against the positioning plate 37.

The positioning plates 36, 37 are secured to the side plate (not shown) to which the main scanning rail 7 is attached. With this arrangement, the relative positional accuracy between the positioning plates 36, 37 and the main scanning rail 7 can be maintained, thus improving the relative positional accuracy between the carriage 5, and the platen 9, auxiliary scanning roller 14*a*, auxiliary scanning driven roller 14*b*, ejector roller 15*a* and ejector driven roller 15*b* which are attached to the chassis 16, and improving the recording accuracy of the recording head 8 mounted on the carriage 5.

Further, the positioning plates 38, 39 are integrally attached to the recovery unit 10 for the following reasons.

(1) As mentioned above, it is necessary to maintain the relative positional accuracies between the recording head 8, recovery unit 10, platen 9, auxiliary scanning roller 14*a* and auxiliary scanning driven roller 14*b*, and ejector roller 15*a* and ejector driven roller 15*b*. To this end, the positioning plates 36, 37 are attached to the side plate (not shown) to which the main scanning rail 7 is secured, thus positioning the chassis 16 at its one side. Even when the positioning plates 38, 39 for positioning the chassis 16 at its other side are attached to the other side plate (near the recovery unit 10 in the direction B in FIG. 1), there is no problem regarding the accuracy. However, if the positioning plates 38, 39 are attached to the other side plate (not shown), the other side plate to which the main scanning rail 7 is attached is arranged between the chassis 16 and the recovery unit 10, which will interfere with the scanning movement of the carriage 5. Further, when the other side plate to which the main scanning rail 7 is secured is arranged at a position further spaced apart from the recovery unit 10 in the direction B in FIG. 1, the positioning plates 38, 39 are also further spaced apart from the recovery unit 10 in the direction B, thus interfering the chassis 16 with the recovery unit 10.

(2) Since the recovery unit 10 is positioned by the other side plate (not shown) to which the main scanning rail 7 is secured, when the positioning plates 38, 39 are attached to the recovery unit 10, the relative positional accuracy between the recording head 8, recovery unit 10 and chassis 16 is not worsened.

Incidentally, in this embodiment, while the positioning plates 38, 39 were attached to the recovery unit 10 as discrete parts, these positioning plates 38, 39 may be integrally formed with the recovery unit 10. Further, when the recovery unit 10 is supported by a member secured to the other side wall, the positioning plates 38, 39 may be secured to this member or may be integrally formed with this member.

Next, a lifting/lowering movement of the chassis 16 viewed from a direction shown by the arrow G in FIG. 1 will be explained with reference to FIGS. 4A to 4C and 5A to 5C. FIG. 4C shows the chassis 16 in a lifted position, and FIG. 5C shows the chassis 16 in a lowered position. Further, FIGS. 4A and 4B show conditions that the chassis 16 is being lifted, and FIGS. 5A and 5B show conditions that the chassis 16 is being lowered.

Now, explaining an elevator mechanism for the chassis 16, as shown in FIG. 1, both ends of a rotary shaft 30*d* are rotatably supported by bearings 30*a*, 30*b*, and levers 43*a*, 43*b* are pivotally mounted on the rotary shaft 30*d*. A grip 30*e* has both ends secured to the levers 43*a*, 43*b*. Further, as shown in FIG. 4B, the levers 43*a*, 43*b* are provided with U-shaped recesses 43*c*, 43*d*. A slider 14 has elongated slots 44*a*, 44*b*, 44*c* formed therein and has a shaft 44*d* extending perpendicular to a plane of FIG. 4B. Rollers 45*a*, 45*b* are rotatably supported on the shaft 44*d* and are adapted to be received in the U-shaped recesses 43*c*, 43*d* of the levers 43*a*, 43*b*. The slider 44 is slidably supported by support plates 46*a*, 46*b* so that it can be shifted in the direction K in FIG. 4B or in the direction J in FIG. 5B along the elongated slots 44*a*, 44*c*.

Incidentally, hereinbelow, the elevator mechanism for the chassis will be explained regarding the operation thereof effected by the support plate 46*a*, lever 43*a* and the like which are arranged this side as to Figures, and explanation of the support plate 46*b*, lever 43*b* and the like arranged at the other side will be omitted.

Figure 4A:
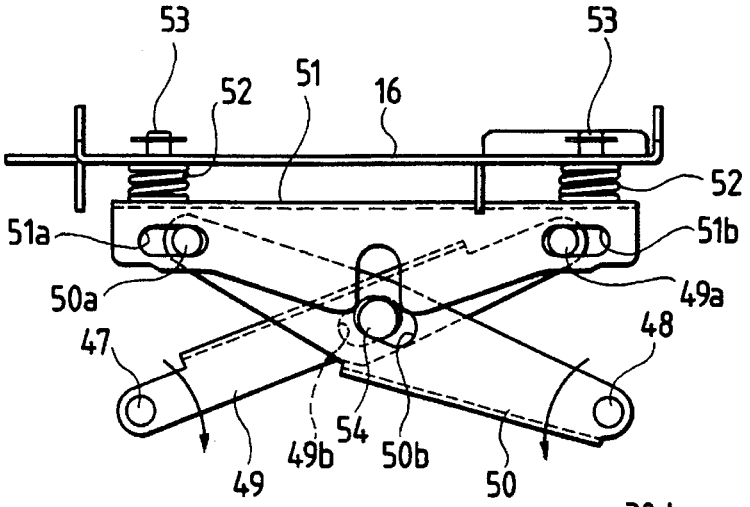
FIGS. 4A to 4C are explanatory views for explaining a lifting movement of a chassis.
Figure 4B:
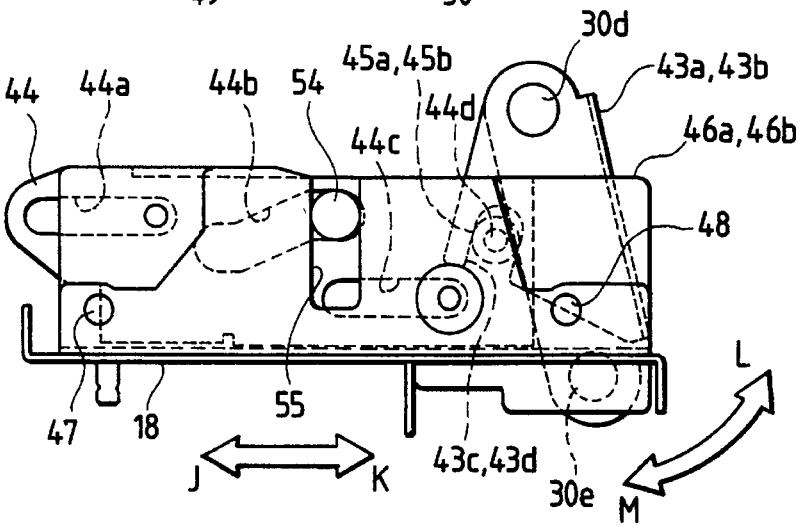
Figure 4C:
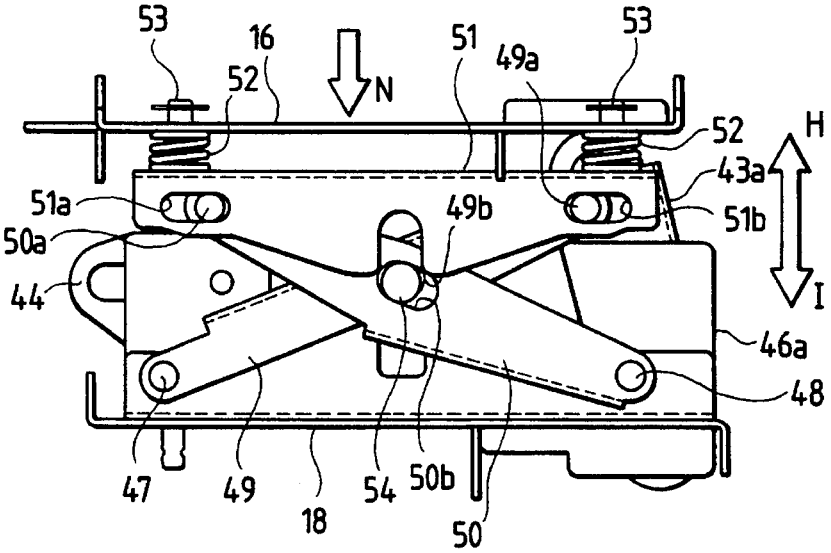
Figure 5A:
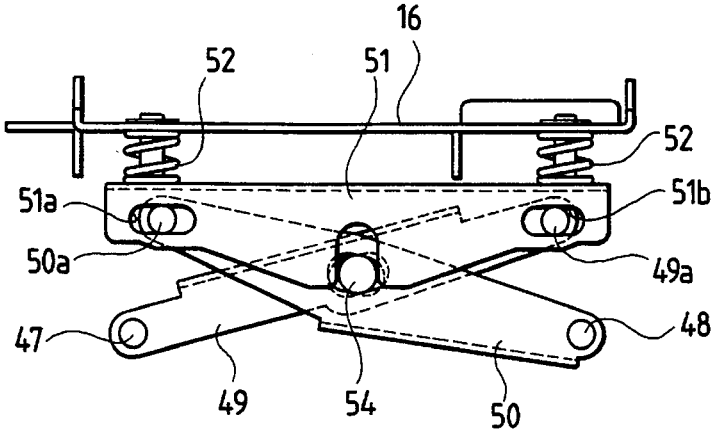
FIGS. 5A to 5C are explanatory views for explaining a lowering movement of the chassis.
Figure 5B:
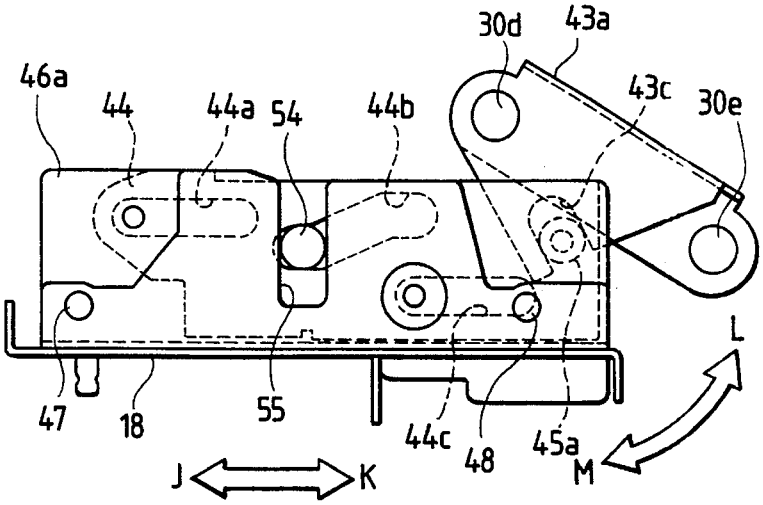
Figure 5C:
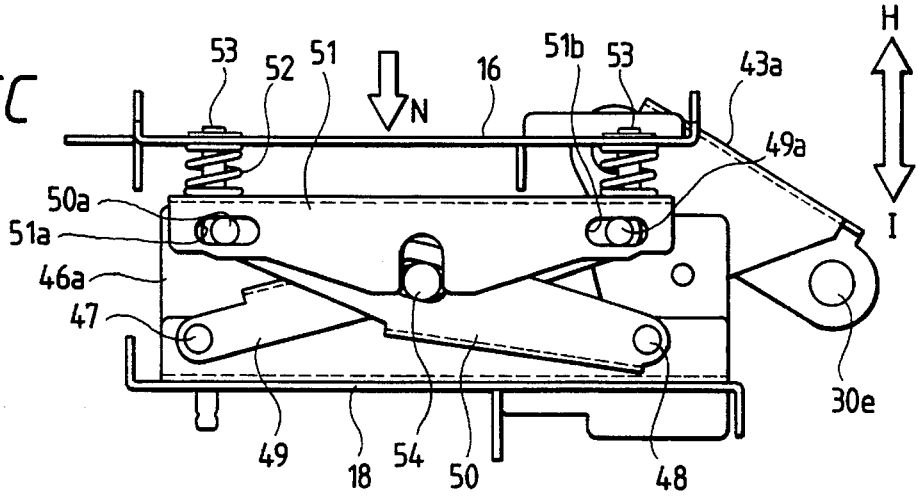

As shown in FIG. 4B, pins 47, 48 are formed on a front (this side) surface of the support plate 46*a*, and, as shown in FIG. 4A, levers 49, 50 are rotatably mounted on the pins 47, 48. Rollers 49*a*, 50*a* are rotatably mounted on free ends of the levers 49, 50 and are received in elongated slots 51*a*, 51*b* formed in a support plate 51, thus supporting the support plate 51. Compression springs 52 rested on the support plate 51 are guided by pins 53 of the support plate 51 and serve to bias the chassis 16 upwardly.

FIG. 4A shows a condition that the chassis 16 is lifted. In this condition, as shown in FIG. 1, the chassis 16 is positioned by the positioning plates 36, 37, 38, 39 in the height direction, and is urged against the positioning plates 36, 37, 38, 39 by compressing the compression springs 52, and thus, fixed with respect to these positioning plates. The reference numeral 54 denotes a shaft extending from the elevator mechanism regarding the front support plate 46*a* to the elevator mechanism regarding the rear support plate 46*b*. This shaft passes through the slot 44*b* (FIG. 4B) of the slider 44 and elongated slots 49*b*, 50*b* (FIG. 4A) of the levers 49, 50. Further, as shown in FIG. 4B, the support plate 46*a* is provided with a U-shaped notch 55 through which the shaft 54 passes for movement in an up-and-down direction along the notch.

After the jam treatment is effected by retracting the chassis 16 from the apparatus, the chassis is re-inserted into the apparatus. Regarding this, a mechanism for preventing the chassis 16 from being lifted during the re-insertion of the chassis 16 into the apparatus is provided on the chassis 18. Now, this lift preventing mechanism will be explained with reference to FIGS. 6 and 7. Similar to the above, the lift preventing mechanism adjacent to the elevator mechanism relating to the front support plate 46*a*, front lever 43*a* and the like will be explained, and the explanation of the other lift preventing mechanism arranged at the other side will be omitted.

Figure 6:
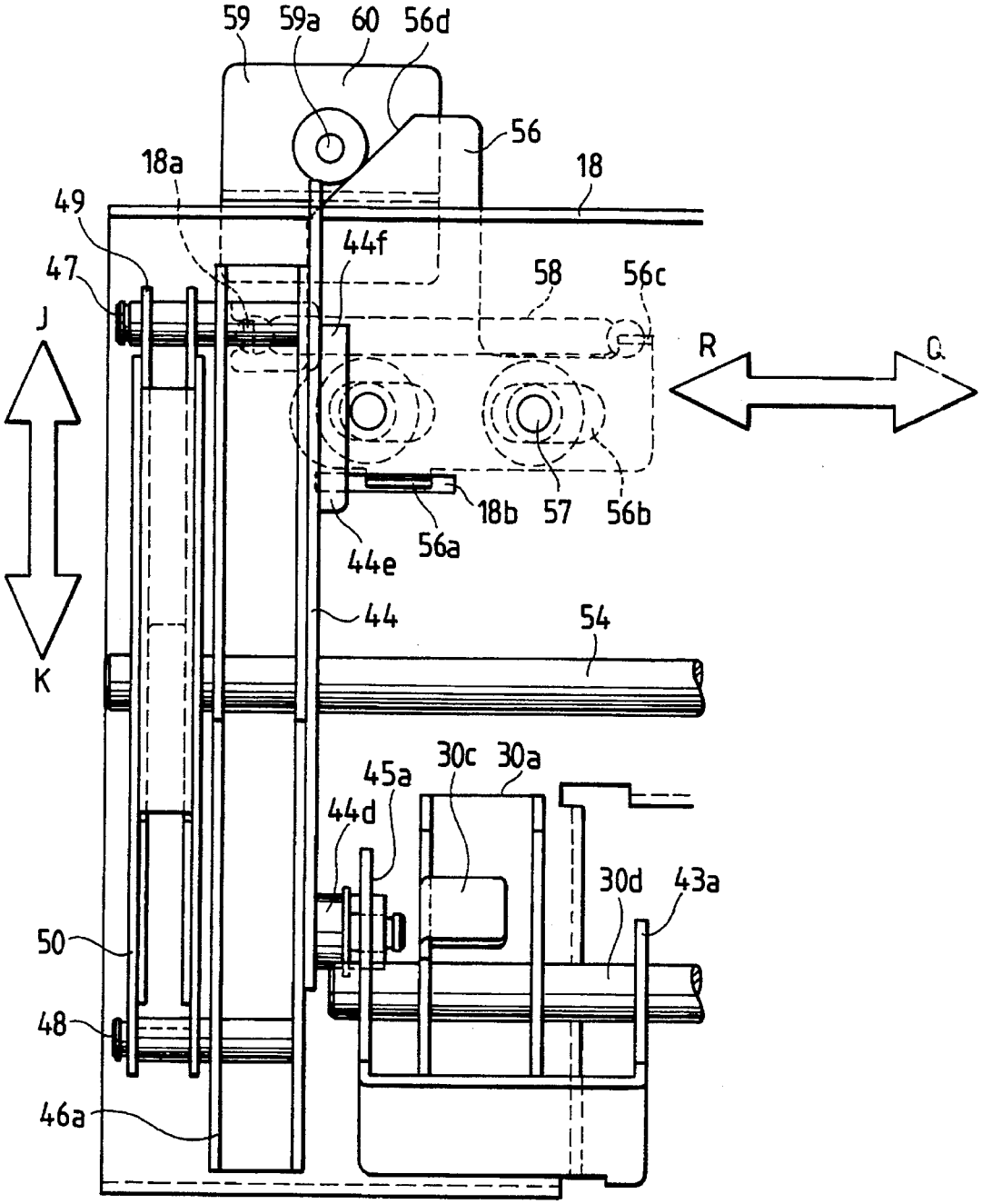
FIG. 6 is a plan view viewed from a direction shown by the arrow N in FIG. 4C.
Figure 7:
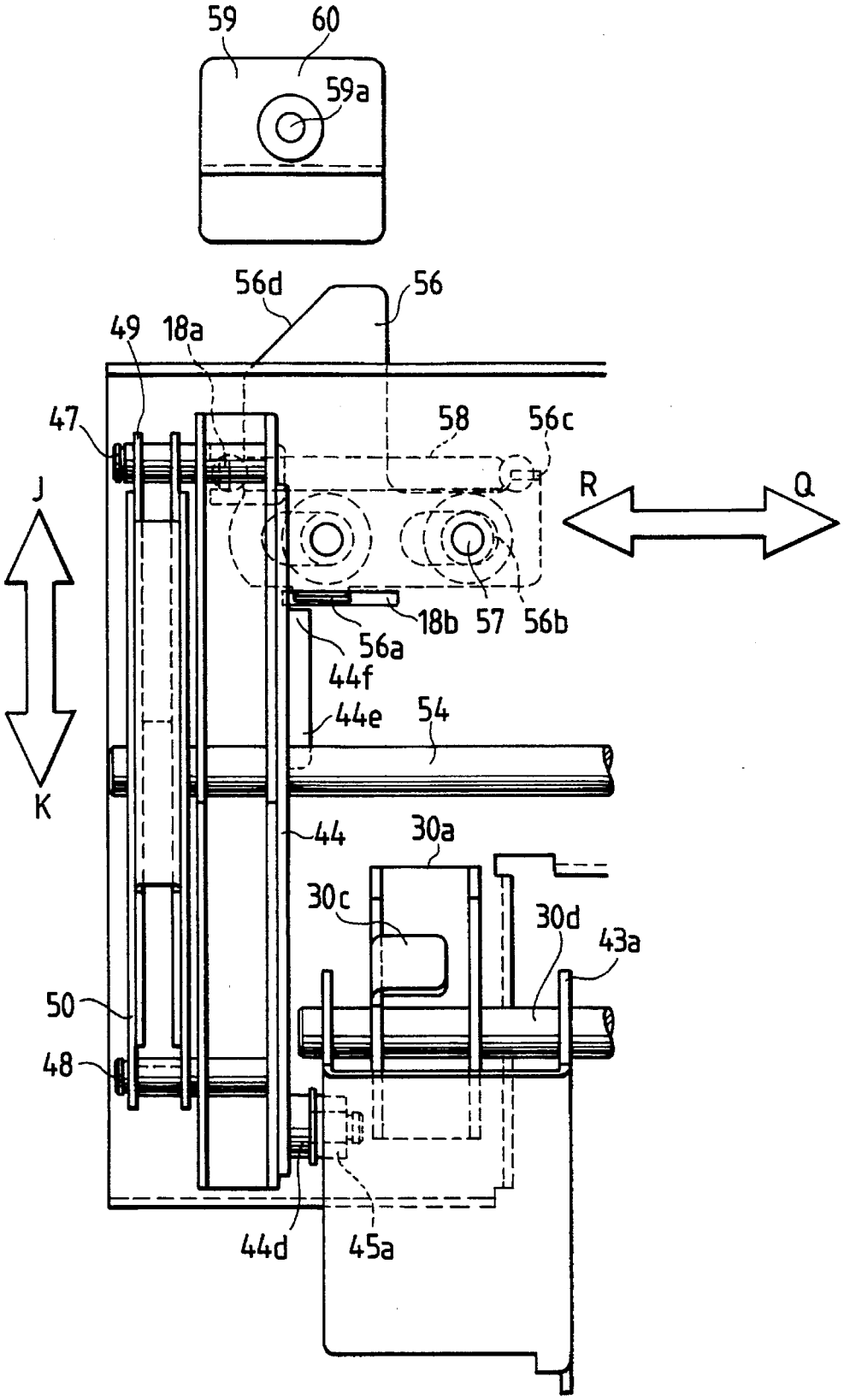
FIG. 7 is a plan view viewed from a direction shown by the arrow N in FIG. 5C, showing the chassis slightly retracted in a direction shown by the arrow K.

FIG. 6 is a view from the direction N of FIG. 4C omitting the chassis 16, pins 53, compression springs 52, support plate 51 and rollers 49*a*, 50*a*. Further, FIG. 7 is a view from the direction N of FIG. 5C shifted in the direction K in FIG. 3 and omitting the chassis 16, pins 53, compression springs 52, support plate 51 and rollers 49*a*, 50*a*.

In FIG. 6, a pawl portion 44*e* is formed on the slider 44 at a predetermined position by bending a portion of the slider, which pawl portion can be engaged by an engagement pawl portion 56*a* formed on a rock lever 56 by bending a portion of this lever forwardly. The rock lever 56 is provided with two slots 56*b*, a rearwardly bent spring holder portion 56*c* and an inclined surface 56*d*. By inserting two pins 57 formed on the rear surface of the chassis 18 into the slots 56*b*, the rock lever is supported for pivotal movement in directions shown by the arrows Q, R.

A tension spring 58 is connected between the spring holder portion 56*c* of the rock lever 56 and a spring holder portion 18*a* formed on the chassis 18 by bending a portion of this chassis rearwardly, thus biasing the rock lever 56 toward the direction R. Further, the chassis 18 is provided with an aperture 18*b* through which the engagement pawl portion 56*a* of the rock lever 56 protrudes forwardly from the rear surface side of the chassis 18.

An angle 59 is disposed in the vicinity of the rock lever 56, and a roller 60 is rotatably mounted on a shaft 59*a* secured to the angle 59. As shown in FIG. 6, in the condition that the rock lever 56 is biased toward the direction R, the roller 60 is engaged by the inclined surface 56*d* of the rock lever 56, thus shifting the rock lever 56 in the direction Q in opposition to a tension force of the tension spring 58.

Next, a retracting and re-inserting operation of the conveying means of the printer as constructed above during the jam treatment will be explained.

(Lowering movement)

In FIG. 1, when the recording sheet 3 is jammed, an operator opens the ejection door 61 and shifts the carriage 5 onto the recovery unit 10 as shown by the two dot and chain line in FIG. 1. Then, the operator pulls the grip 30*e* in the direction L in FIG. 4B. Consequently, the levers 43*a*, 43*b* are rotated around the rotary shaft 30*d*, together with the U-shaped recesses 43*c*, 43*d* formed therein. Meanwhile, a rotational force is transmitted to the shaft 44*d* via the rollers 45*a*, 45*d* engaged by the recesses 43*c*, 43*d*, thus shifting the slider 44 in the direction K along the slots 44*a*, 44*c*.

When the slider 44 is shifted in the direction K, the shaft 54 is lowered along the slot 44*b*. As shown in FIG. 4A, since the shaft 54 passes through the slots 49*b*, 50*b* of the levers 49, 50 the lever 49 is rotated around the pin 47 in a direction shown by the arrow P and the lever 50 is rotated around the pin 48 in a direction shown by the arrow S. Since the rollers 49*a*, 50*a* supported on the free ends of the levers 49, 50 are received in the slots 51*a*, 51*b* of the support plate 51, respectively, the rotation of the levers 49, 50 causes the support plate 51 to lower in the direction I in FIG. 4C, thus lowering the chassis 16 via the compression springs 52 (refer to FIG. 5C).

(Releasing of recording sheet holding force)

When the chassis 16 is lowered as mentioned above, the cam portions 12*c*, 13*c* (FIG. 3) of the levers 12, 13 are abutted against the cam portion 19*a* of the sheet guide 19, thus rotating the levers 12, 13 around the bearing holes 12*a*, 13*a* in the direction D in opposition to the tension forces of the tension springs 17. As a result, the auxiliary scanning roller 14*a* and the auxiliary scanning driven roller 14*b* are shifted from the recording position holding the recording sheet 3 to a holding force releasing position where the auxiliary scanning roller 14*a* is slightly spaced apart from the auxiliary scanning driven roller 14*b*, thus releasing the holding force pinching the recording sheet 3.

Further, when the chassis 16 is lowered, the cam portions 27*b*, 28*b* of the levers 27, 28 secured to the levers 25, 26 are abutted against the cam portion 30*c* of the bearings 30*a*, 30*b* and the cam portion 31*a* of the angle 31, respectively, thus rotating the levers 25, 26 around the bearing holes 26*b* in the direction E in opposition to the tension forces of the tension spring 29, with the result that the ejector driven roller 15*b* held by the bent portions 25*a*, 26*a* of the levers 25, 26 is slightly separated from the ejector roller 15*a*. In this way, by shifting the ejector roller 15*a* and the ejector driven roller 15*b* from the recording position holding the recording sheet 3 to the holding force releasing position where the ejector roller 15*a* is slightly spaced apart from the ejector driven roller 15*b*, thus releasing the holding force pinching the recording sheet 3.

(Retracting movement)

When the holding forces between the rollers constituting the conveying means for the recording sheet 3 are released as mentioned above, as shown in FIG. 5B, by pulling the grip 30*e* in the direction L, a lock mechanism (not shown) for the chassis 18 is released, and the chassis 18 can be shifted in the direction K. Such lock mechanism may be constituted by a conventional mechanism utilizing an inversion spring. Thus, the whole conveying means for the recording sheet 3 can be retracted from the printer to a jam treatment position.

(Jam treatment)

When the conveying means is retracted from the printer, since a large space is created in the printer, the operator can insert his hand into this space and can take the jammed recording sheet 3 out. Although the recording sheet 3 may be jammed at various locations in the printer, for example, even if the recording sheet 3 is jammed as shown by the two dot and chain line in FIG. 2 after it is supplied from the cassette 1 or 2 for a small distance, it is possible to remove the jammed recording sheet 3 without trouble. Further, even when the recording sheet 3 is jammed with being pinched between the auxiliary scanning roller 14*a* and the auxiliary scanning driven roller 14*b* or between the ejector roller 15*a* and the ejector driven roller 15*b*, since the holding forces for the recording sheet 3 are released in the conveying means, it is possible to easily remove the jammed recording sheet 3.

For example, when the recording sheet 3 is jammed in a condition that a significant trailing end portion of such recording sheet remains in the cassette, since a leading end portion of such recording sheet is in the space (created by retracting the conveying means) in the printer, the operator can easily remove such jammed recording sheet by hand. Further, when the trailing end portion of the recording sheet 3 supplied from the cassette is jammed between the auxiliary scanning roller 14*a* and the auxiliary scanning driven roller 14*b* or between the ejector roller 15*a* and the ejector driven roller 15*b*, since the jammed recording sheet 3 is retracted together with the conveying means out of the printer, the recording sheet can easily be removed by pulling it in the direction T or U in FIG. 2.

(Re-inserting movement)

When the jam treatment is finished, the operator re-inserts the conveying means via the grip 30*e* from the position of FIG. 2 in the direction J until the lock mechanism for the chassis 18 in the printer starts to operate. In this point, the grip 30*e* and the levers 43*a*, 43*b* are positioned at locations 30*e'*, 43*a'*, 43*b'*, respectively, shown by the two dot and chain line in FIG. 3. Thereafter, the grip 30*e'* is further inserted into the position 30*e* to lift the conveying means. However, when the grip 30*e* is positioned at the location 30*e'*, the operator sometimes closes the ejection door 61 erroneously.

To avoid such inconvenience, in the illustrated embodiment, it is so designed that, when the grip 30*e* and the levers 43*a*, 43*b* are positioned at the locations 30*e'*, 43*a'*, 43*b'*, even if the operator tries to close the ejection door 61, the latter cannot be closed due to interference with the grip 30*e'* and the levers 43*a'*, 43*b'*. Further, in the illustrated embodiment, the opening/closing movement of the ejection door 61 is detected by a switch (not shown) so that the carriage 5 cannot be shifted so long as the ejection door 61 is opened. That is to say, only when the conveying means is returned to the recording position, the ejection door 61 can be closed and the carriage 5 is placed the operative condition. Thus, so long as the conveying means is lowered, the carriage 5 cannot operate. In this way, it is possible to prevent the carriage 5 from dropping on the lowered platen 9, thus preventing the damage of the nozzles of the recording head 8 and ensuring the safety of the apparatus.

(Lift preventing operation)

When the conveying means is positioned at the recording position in the printer, as shown in FIG. 6, the rock lever 56 is biased toward the direction R by the tension force of the tension spring 58 so that the inclined surface 56*d* is abutted against the roller 60. From this condition, when the operator pulls the grip 30*e* (FIG. 1) in the direction L in FIG. 4B, the slider 44 is shifted in the direction K as mentioned above. When the grip 30*e* is further pulled, the lock mechanism (not shown) which has held the chassis 18 at the position of FIG. 6 is released, with the result that the chassis 18 is shifted in the direction K in FIG. 6 to reach a condition shown in FIG. 7.

In FIG. 7, since the inclined surface 56*d* of the rock lever 56 is separated from the roller 60, the rock lever 56 is shifted in the direction R, and the engagement pawl portion 56*a* reaches behind an engagement end portion 44*f* of the slider 44 which has already been shifted in the direction K. As a result, the movement of the slider 44 in the direction J is prevented. In this condition, the jam treatment is effected by further retracting the chassis 18 in the direction K. After the jam treatment, the chassis 18 is shifted in the direction J by pushing the grip 30*e* in the direction M. However, in this case, as mentioned above, since the slider 44 cannot be shifted in the direction J, the chassis 16 cannot be lifted to the original position.

When the chassis 18 is shifted in the direction J, the lock mechanism (not shown) operates to lock the position of the chassis 18, and the inclined surface 56*d* of the rock lever 56 is abutted against the roller 60, thus shifting the rock lever 56 in the direction Q in opposition to the tension force of the tension spring 58. Consequently, the engagement pawl portion 56*a* is separated from the end 44*f* of the slider 44, with the result that the slider 44 can be shifted in the direction J. In this condition, when the grip 30*e* is further pushed in the direction M, the slider 44 is shifted in the direction J to shift the chassis 18. When the chassis 18 is shifted up to the holding force releasing position, the chassis 16 is lifted.

Incidentally, in the illustrated embodiment, even if the chassis 16 is lifted in the condition that the conveying means has been retracted from the printer, as shown in FIG. 2, since the chassis 16 is interfered with the positioning plate 37, the chassis cannot be inserted into the printer.

(Lifting movement)

As mentioned above, when the grip 30*e* is rotated in the direction M, the driving force is transmitted reversely in the case of the lowering movement of the chassis 16, thus shifting the slider 44 in the direction J. Consequently, as shown in FIG. 4B, the shaft 54 is lifted while being guided by the slot 44*b* to lift the support plate 51 via the levers 49, 50, thus lifting the chassis 16. In this case, the chassis 16 is firmly positioned by the fitted engagements between the positioning pins 36*a*, 38*a*, 39*a* of the positioning plates 36, 38, 39 and the guides 40, 41, 42 and by the abutment between the positioning plate 37 and the chassis 16 by the urging forces of the compression springs 52. Thus, it is possible to position the conveying means at the recording position safely and correctly.

In the illustrated embodiment, while the ink jet recording system was used as the recording means, the recording means may preferably be designed so that electrical/thermal converters are energized in response to the recording signal, and the ink is discharged from the discharge opening by growing a bubble in the ink by the heat exceeding the film boiling generated by the energization of the electrical/thermal converter.

Preferably, the typical construction and principle thereof can be realized by using the fundamental principles, for example, disclosed in U.S. Pat. Nos. 4,723,129 and 4,740,796. Although this system can be applied to both a so-called "on-demand type" and "continuous type", it is more effective when the present invention is particularly applied to the on-demand type, because, by applying at least one drive signal corresponding to the record information and consequently providing the abrupt temperature increase exceeding the nucleate boiling to the electrical/thermal converters arranged in correspondence to the sheet or liquid passages including the liquid (ink) therein, it is possible to form a bubble in the liquid (ink) corresponding to the drive signal by generating the film boiling on the heat acting surface of the recording head due to the generation of the thermal energy in the electrical/thermal converting elements. Due to the growth and contraction of the bubble, the liquid (ink) is discharged from the discharge opening to form at least one ink droplet. When the drive signal has a pulse shape, since the growth and contraction of the bubble can be quickly effected, more excellent ink discharge is achieved.

Such pulse-shaped drive signal may be as disclosed in U.S. Pat. Nos. 4,463,359 and 4,345,262. Incidentally, by adopting the condition disclosed in U.S. Pat. No. 4,313,124 regarding the temperature increasing rate on the heat acting surface, a further excellent recording can be performed.

As the construction of the recording head, the present invention includes the construction wherein the heat acting portion is disposed in an arcuate area as disclosed in U.S. Pat. Nos. 4,558,333 and 4,459,600, as well as the constructions wherein the discharge openings, liquid paths and electrical/thermal converters are combined (straight liquid paths or orthogonal liquid paths) as disclosed in the above U.S. Patents. In addition, the present invention can be applicable to the construction wherein each discharge opening is constituted by a slit with which a plurality of electrical/thermal converters associated in common as disclosed in the Japanese Patent Laid-Open No. 59-123670 and the construction wherein openings for absorbing the pressure wave of the thermal energy are arranged in correspondence to the discharge openings as disclosed in the Japanese Patent Laid-Open No. 59-138461, because the recording can be correctly and effectively performed regardless of the configuration of the recording head.

Further, among the above-mentioned recording heads of serial type, a recording head secured to the carriage or a removable recording head of chip type wherein, when mounted on the carriage, electrical connection between it and the recording apparatus and the supply of ink from the recording apparatus can be permitted, as well as a recording head of cartridge type wherein a cartridge is integrally formed with the head may be used.

Further, it is preferable that a head recovering means and an auxiliary aiding means are added to the recording head according to the present invention, since the effect of the present invention is further improved. More concretely, these means include a capping means for capping the recording head, cleaning means, pressurizing or suction means, and an auxiliary heating means comprising electrical/thermal converters or other heating elements or the combination thereof. Further, it is effective for the stable recording to perform an auxiliary discharge mode wherein auxiliary ink discharge independent of the recording ink discharge is effected.

Further, as to the kind and number of the recording heads to be mounted on the carriage, each recording head may correspond to each different color ink, or a plurality of recording heads can be used for a plurality of inks having different colors and/or different densities. That is to say, for example, as the recording mode of the recording apparatus, the present invention can effectively be applied not only to a recording mode with a single main color such as black, but also to system providing a plurality of different colors and/or a full-color by mixing colors by using an integrated recording head or the combination of plural recording heads.

Further, in the illustrated embodiments, while the ink was liquid, the ink may be solidified in a room temperature or less and be softened or liquefied at a room temperature. In the ink jet recording system, since the temperature control is generally effected in a temperature range from 30° C. to 70° C. so that the viscosity of the ink is maintained within a stable discharging range, the ink may be liquefied when the record signal is emitted. In addition, ink having a feature that it is first liquefied by the thermal energy, such as solid ink which serves to prevent the increase in temperature by absorbing energy in changing the ink from the solid state to the liquid state or which is in the solid state in the preserved condition to prevent the evaporation of the ink and which is liquefied into ink liquid to be discharged in response to the record signal comprising the thermal energy, or ink which has already been solidified upon reaching the recording medium, can also be applied to the present invention. In such a case, the ink can be held in the liquid state or solid state in recesses or holes in a porous sheet as disclosed in the Japanese Patent Laid-Open Nos. 54-56847 and 60-71260, in confronting relation to the electrical/thermal converters.

Further, the above-mentioned ink jet recording apparatus may be in the form of a recording apparatus used as an image outputting terminal equipment of an information processing system such as a computer, or a copying machine combined with a reader, or a facsimile system having the communication ability.

Figure 8:
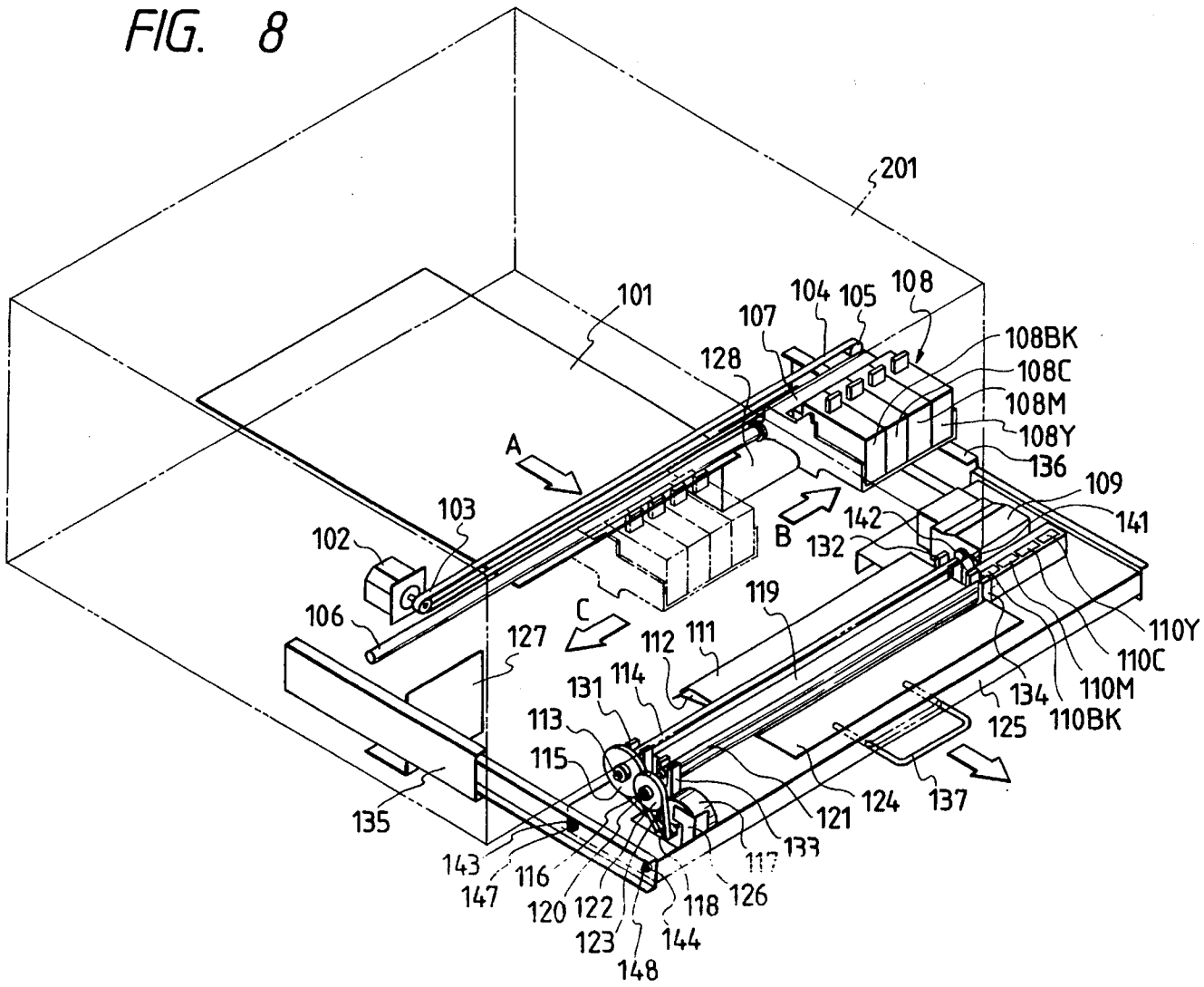
FIG. 8 is a perspective view of an image recording apparatus according to a second embodiment of the present invention.
Figure 9:
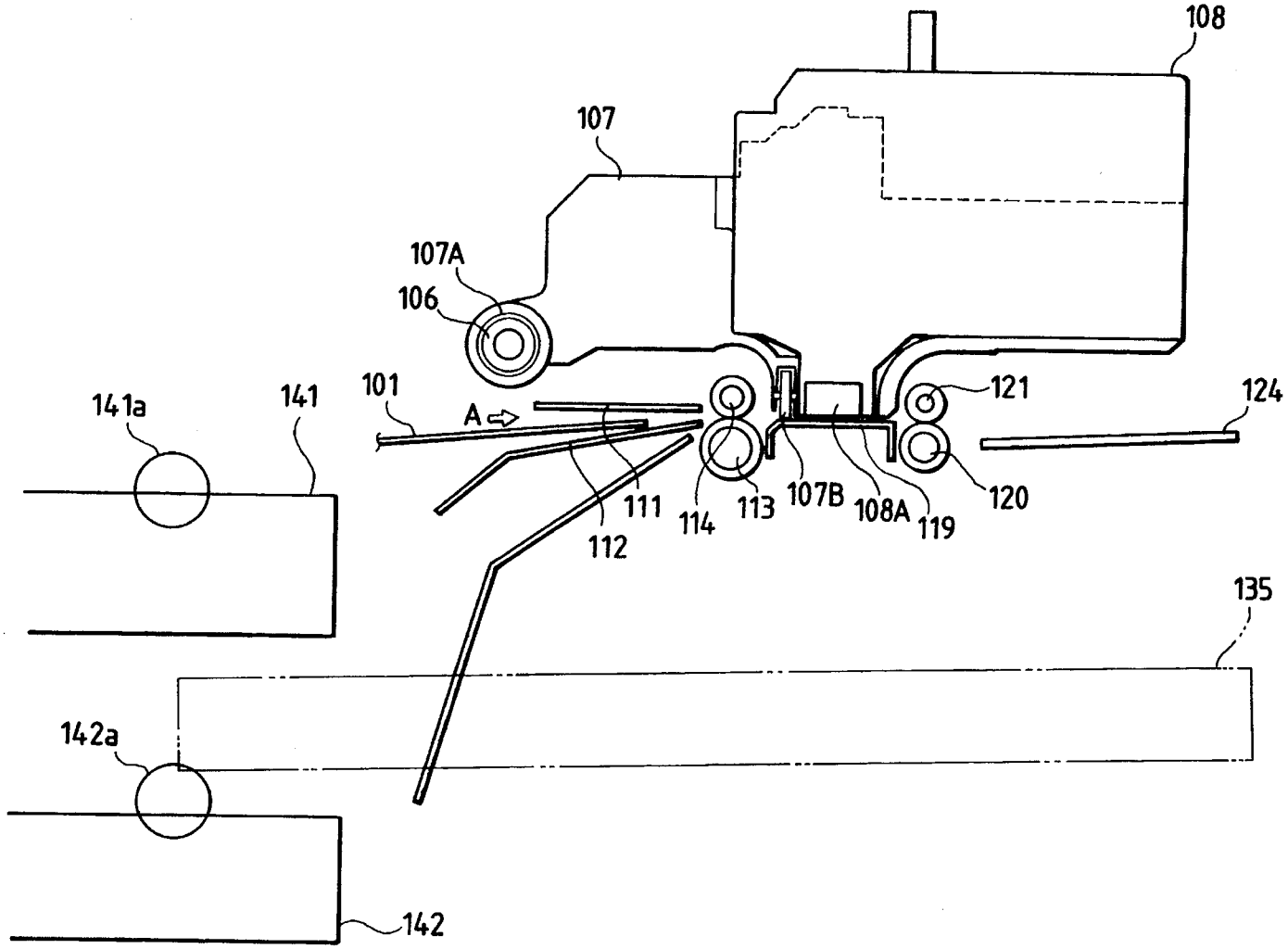
FIG. 9 is a schematic view showing a recording portion.

Next, a second embodiment of the present invention will be explained with reference to FIGS. 8 and 9. Incidentally, FIG. 8 is a perspective view of a main portion of an image recording apparatus and FIG. 9 is a schematic elevational sectional view of a main portion of the image recording apparatus. In this embodiment, at a recording station, a recording sheet is intermittently fed in a predetermined direction by means of a convey roller mechanism, and an ink jet mechanism acting as a recording means is scanned in a direction perpendicular to a sheet feeding direction.

An auxiliary scanning roller 113 and an auxiliary scanning driven roller 114 are rotatably supported at their both ends by bearing portions 131, 132 secured to a base 125, so that a recording sheet 101 advancing from a direction shown by the arrow A can be fed to the right by the rotation of these rollers. A platen 119 for supporting the fed recording sheet 101 is secured to the base 125 downstream of the auxiliary scanning roller 113 in the sheet feeding direction. Further, an ejector roller 120 and an ejector driven roller 121 urged against the ejector roller 120 are disposed at a downstream side of the platen 119 in the sheet feeding direction. The ejector roller 120 and the ejector driven roller 121 are rotatably supported at their both ends by bearing portions 133, 134 secured to the base 125. Since the bearing portions for the rollers are supported by the same base 125, the heights of a contacting portion between the auxiliary scanning roller 113 and the auxiliary scanning driven roller 114 and a contacting portion between the ejector roller 120 and the ejector driven roller 121 can be regulated with high accuracy, and the parallelism between these contacting portions can also be regulated with high accuracy.

An upper guide 111 and a lower guide 112 supported by the base 125 serve to direct the recording sheet 101 to the contacting portion (nip) between the auxiliary scanning roller 113 and the auxiliary scanning driven roller 114. Since these guides are supported by the same base 125 as that for the bearing portion 131 of the auxiliary scanning roller 113, the positional relation between the guides and the auxiliary scanning roller can be regulated with high accuracy. An ejection guide 124 serves to guide the recording sheet 101 fed by the ejector roller 120 and the ejector driven roller 121 out of the apparatus 201.

An auxiliary scanning pulley 115 is secured to a left (FIG. 8) end of the auxiliary scanning roller 120, and, similarly, an ejector pulley 122 is secured to a left end of the ejector roller 120. On the other hand, at a left lower portion of the base 125, a convey motor 117 is secured to the base 125 via a motor holding bracket 126. A convey motor pulley 118 is secured to a rotary shaft of the convey motor 117, which convey motor pulley can transmit a rotational driving force to the auxiliary scanning pulley 115 and the ejector pulley 122 via an auxiliary scanning belt 116 and an ejector belt 123. In this case, a diameter of the ejector pulley 122 is so selected that a convey speed of the ejector roller 120 becomes slightly faster than that of the auxiliary scanning roller 113. Further, since a pinching force of the nip between the auxiliary scanning roller 113 and the auxiliary scanning driven roller 114 is selected to be greater than that of a pinching force of the nip between the ejector roller 120 and the ejector driven roller 121, a feeding amount of the recording sheet 101 is defined by the auxiliary scanning roller 113, thus preventing the recording sheet 101 from being slacked on the platen 119.

A main scanning rail 106 extending in parallel with an axial direction of the auxiliary scanning roller 113 is secured to the apparatus 201 above the platen 119 at the left side thereof. A carriage 107 has a bearing portion 107A slidably fitted on the main scanning rail 106 so that the carriage can be shifted in an axial direction (shown by the arrows B and C in FIG. 8) of the main scanning rail 106. A main scanning motor 102 is disposed above the main scanning rail 106 at the left side thereof and is secured to a side wall of the apparatus 201. A main scanning motor pulley 103 is secured to a rotary shaft of the main scanning motor 102 to rotate together with the rotary shaft. An idler pulley 105 is rotatably supported by the side wall of the apparatus 201 at a position corresponding to the main scanning pulley 103 and spaced apart from the latter in the direction B in FIG. 8.

A main scanning belt 104 extends between the main scanning motor pulley 103 and the idler pulley 105 and turns in synchronous with the rotation of the main scanning motor 102. Between the pulleys 103, 105, the main scanning belt 104 is connected to the carriage 107, so that the carriage 107 can be shifted in the direction B or C by the rotation of the main scanning motor 102. A roller 107B (FIG. 9) is rotatably mounted on a lower portion of the carriage 107, which roller can keep a distance between the carriage 107 and the recording sheet 101 constant by rolling on the recording sheet 101 supported on the platen.

Four ink cartridges including different color inks are secured to the carriage 107 at predetermined positions. The ink cartridge for black color ink is designated by 108BK, the ink cartridge for cyan color ink is designated by 108C, the ink cartridge for magenta color ink is designated by 108M, and the ink cartridge for yellow color ink is designated by 108Y. As shown in FIG. 9, an ink jet head 108A comprising a plurality of nozzles arranged in a direction perpendicular to a shifting direction of the carriage 107 and a mechanism for applying ink discharging forces to the nozzles is disposed on the bottom of each ink cartridge in confronting relation to the platen 119. Each ink jet head 108A can discharge ink in the corresponding ink cartridge as ink dots toward the recording sheet 101 supported on the platen 119. The ink jet head 108A can utilize various ink discharging energy generating means. In the illustrated embodiment, each ink jet head 108A has a thermal energy generating means (for example, electrical/thermal converters or laser beams and the like) which generates the thermal energy to cause the change in the ink state or condition. According to this system, it is possible to attain the high density and high fineness of the recording.

When the carriage 107 and the ink cartridges 108Y, 108M, 108C, 108BK are in a non-operative condition (non-recording condition), the carriage 107 can be shifted to a position (shown by the solid line in FIG. 8) out of a recording area together with the ink cartridges 108Y, 108M, 108C, 108BK under the control of the main scanning motor 102. When the carriage 107 is situated in this position, in order to prevent the jamming of the nozzles due to the drying of ink therein, cap portions 110Y, 110M, 110C, 110BK for sealing the nozzles in the corresponding ink jet head 108A to keep the interior of the nozzles in a wetted condition are arranged on the base 125.

Further, a recovery unit 109 for recovering any abnormity in the ink discharge due to the unnecessary bubbles and (or) foreign matters generated in the nozzles is arranged on the base 125 behind the ink cartridges 108Y, 108M, 108C, 108BK. The recovery unit 109 includes therein a suction pump for reducing the pressures in the cap portions 110Y, 110M, 110C, 110BK, sucking the unnecessary bubbles and (or) foreign matters in the nozzles together with the ink and removing them from the nozzles. The suction pump has a mechanism for converting the rotational driving force into a negative pressure, and thus, the pump can be driven by the rotational driving force from the auxiliary scanning roller 113 via gears 141, 142.

Telescopic slide rails 135,136 are attached at their one ends to the ejection end of the apparatus 201 at both left and right sides (as viewed from the ejection side) between upper and lower cassettes 141' and 142' each containing the recording sheets. On the other hand, engagement holes 143, 144 are formed in the other end of the slide rail 135, and engagement holes (not shown) are formed in the other end of the slide rail 136 in correspondence to the engagement holes 143, 144. Further, engagement pins 147, 148 engaged by the engagement holes 143, 144 and engagement pins engaged by the engagement holes of the slide rail 136 are formed on a lower portion of the base 125 at its both sides. Thus, the base 125 can be shifted in response to the sliding movements of the slide rails 135, 136.

The base 125 to which the upper guide 111, lower guide 112, ejection guide 124, bearing portions (131, 132, 133, 134), platen 119, convey motor 117 and recovery unit 109 are secured is supported by these two slide rails 135, 136 so that it can be retracted in the ejection direction via a grip 137. After retraction, by disengaging the engagement pins 147, 148 and the like from the corresponding engagement holes 143, 144 and the like, the base 125 can be detached from the slide rails.

A recording operation is as follows. The recording sheet 101 is supplied from the cassette 141' or 142' by means of a sheet supply roller 141*a* or 142*a* and is fed in the direction A, and is inserted between the upper and lower guides 111, 112 secured to the base 125. Then, the recording sheet 101 is guided by the guides 111, 112 to reach the nip between the auxiliary scanning roller 113 and the auxiliary scanning driven roller 114. Since the positional relation between the guides 111, 112 and the rollers 113, 114 is regulated with high accuracy, the recording sheet 101 can reach the nip correctly. By drive-controlling the convey motor 117, the auxiliary scanning roller 113 and the auxiliary scanning driven roller 114 are rotated, thus feeding the recording sheet onto the platen 119 and then feeding it to the nip between the ejector roller 120 and the ejector driven roller 121. At this point, the convey motor is stopped temporarily.

Since the heights of the nip between the auxiliary scanning roller 113 and the auxiliary scanning driven roller 114, an upper surface, and the nip between the ejector roller 120 and the ejector driven roller 121 are regulated with high accuracy, and the parallelism between the nip regarding the auxiliary scanning roller 113 and the nip regarding the ejector roller 120 is also regulated with high accuracy, the recording sheet 101 is subjected to uniform feeding direction and convey speed in its widthwise direction, thus being fed properly. Accordingly, the recording sheets 101 are not slacked on the platen 119, thus avoiding the poor sheet feeding.

Then, the main scanning motor 103 is activated to shift the carriage 107 in the direction C in FIG. 8. During this shifting movement of the carriage, ink discharge signals corresponding to the image information are sent from a control portion of the apparatus to the ink jet heads 108A of the ink cartridges 108Y, 108M, 108C, 108BK, thus discharging the ink dots on the recording sheet 101 supported on the platen 119 to form an image of a predetermined width on the recording sheet. Thereafter, the main scanning motor 102 is rotated reversely to shift the carriage 107 in the direction B out of the recording area. After this, by repeating the intermittent feeding operations of the recording sheet 101, the scanning movements of the carriage 107 and the ink discharging operations of the ink jet heads 108A, the two-dimensional image is obtained.

In assembling main elements relating the conveying or feeding of the recording sheet at the recording station, after these elements have previously been assembled on the base 125, the base 125 is pushed and slid via the grip 137 until a rear surface of the base 125 is abutted against stopper plates 127, 128, thus positioning the base. In this case, the relative positional relation between the main elements of the conveying means remains as it is (on the base 125). If the recording sheet 101 is jammed in the vicinity of the recording station, by pulling or retracting the base 125 via the grip 137, since the jammed recording sheet is also retracted together with the base, the jammed sheet can easily be removed.

In this embodiment, since the convey motor 117 and the drive force transmitting system are constituted integrally with the auxiliary scanning roller 113 and the ejector roller 120, there is no change in the tension forces even when the auxiliary scanning belt 116 and the ejector belt 123 are exchanged or dismounted and re-mounted, thus ensuring the stability of the driving response. Accordingly, the constant feeding amount of the sheet can be obtained, thus improving the image quality.

Figure 10:
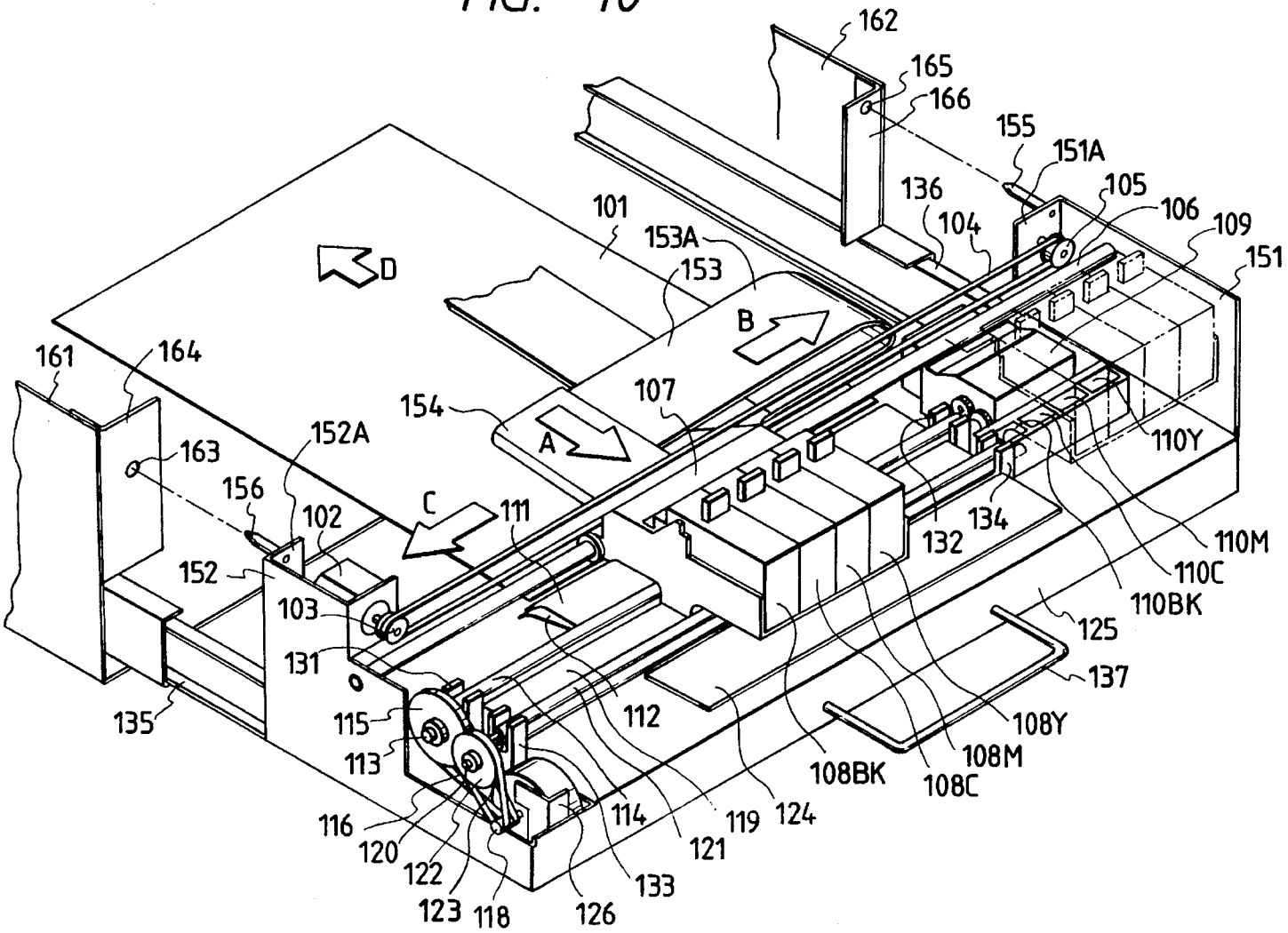
FIG. 10 is a perspective view of an image recording apparatus according to a third embodiment of the present invention.

FIG. 10 shows a third embodiment of the present invention. In this embodiment, a recording means for forming an image on the recording sheet at a recording station and a conveying means for affording a predetermined feeding amount to the recording sheet can bodily be mounted and dismounted with respect to the recording apparatus. Since the conveying means may be the same as that of the above-mentioned first embodiment, the explanation thereof will be omitted.

A right side plate 151 and a left side plate 152 each having a vertical surface perpendicular to a main plane of a base 125 are secured to right and left sides of the base 125, while maintaining the positional relation between these plates with high accuracy. A main scanning rail 106 extending in parallel with an axial direction of an auxiliary scanning roller 113 is disposed above a platen 119 at the left side thereof, and both ends of the rail are supported by the right and left side plates 151, 152. A carriage 107 has a bearing portion 107A slidably fitted on the main scanning rail 106 so that the carriage can be shifted in an axial direction (shown by the arrows B and C) of the main scanning rail 106. A main scanning motor 102 is disposed above the main scanning rail 106 at the left end thereof, and a main scanning motor pulley 103 is secured to a rotary shaft of the motor to rotate together with the rotary shaft.

An idler pulley 105 is rotatably supported by the right side wall 151 at a position corresponding to the main scanning motor pulley and spaced apart from the latter in the direction B. A main scanning belt 104 extends between the main scanning motor pulley 103 and the idler pulley 105 and turns synchronously with the rotation of the main scanning motor 102. Between these pulleys, a portion of the main scanning belt 104 is connected to a rear surface of the carriage 107, so that the carriage 107 can be shifted in the direction B or C by the rotation of the main scanning motor 102. The internal construction of the carriage 107 and the construction of ink cartridges 108 mounted thereon are the same as those of the above-mentioned first embodiment.

A flat cable 153 for transmitting the ink discharge signals from the control portion of the apparatus to ink jet heads is disposed behind the carriage 107, and a cable supporting portion 154 for supporting the flat cable is integrally supported by the carriage 107. The flat cable 153 includes a curved portion 153A having an appropriate slack to compensate for the change in distance between the carriage 107 and the control portion of the apparatus during the scanning movement of the carriage 107 or when the carriage is dismounted from the apparatus.

The positional relation of cap portions 110Y, 110M, 110C, 110BK and recovery unit 109 is the same as that of the first embodiment. Axially telescopic slide rails 135, 136 are secured to left and right lower portions of the base 125. The other ends of the slide rails 135,136 are supported by the apparatus. The right and left side plates 151, 152 have bent walls 151A, 152A directed toward the interior of the apparatus, respectively, and positioning pins 155, 156 protruding toward the interior of the apparatus are secured to the bent walls. On the other hand, a fitting plate 164 having a positioning hole 163 adapted to receive the positioning pin 156 is secured to a left side wall 161 of the apparatus. Similarly, a fitting plate 166 having a positioning hole 165 adapted to receive the positioning pin 155 is secured to a right side wall 162 of the apparatus. A grip 137 is secured to a front surface of the base 125 to be moved together with the base 125.

In assembling, after the various elements have previously been assembled on the base 125, the operator pushes or inserts the base 125 into the apparatus via the grip 137, thus sliding the base 125 along the slide rails 135, 136. As a result, the base is positioned in the direction B, C by fitting the positioning pins 155, 156 into the positioning holes 163, 165 and is also positioned in the direction A, D by abutting the bent walls 151A, 152A against the fitting plates 164,166. If the maintenance and (or) inspection is desired, by performing the above-mentioned operations reversely, the recording system can be dismounted from the apparatus.

With the arrangement as mentioned above, since the main scanning system and the auxiliary scanning system are integrally constructed, it is possible to stabilize the conveying means and to obtain the positional relation between the recording means and the conveying means with high accuracy. Accordingly, since the parallelism between the scanning trace plane for the ink jet heads 108A and the upper surface of the platen 119 and the proper distance between them can be ensured, it is possible to minimize the change in the direction of the discharging ink, thus improving the accuracy of the target points of the ink dots on the recording sheet 101. Further, since the perpendicularity between the main scanning direction and the auxiliary scanning direction can easily be maintained, the perpendicularity between the recording sheet 101 and the image is also improved.

Figure 11:
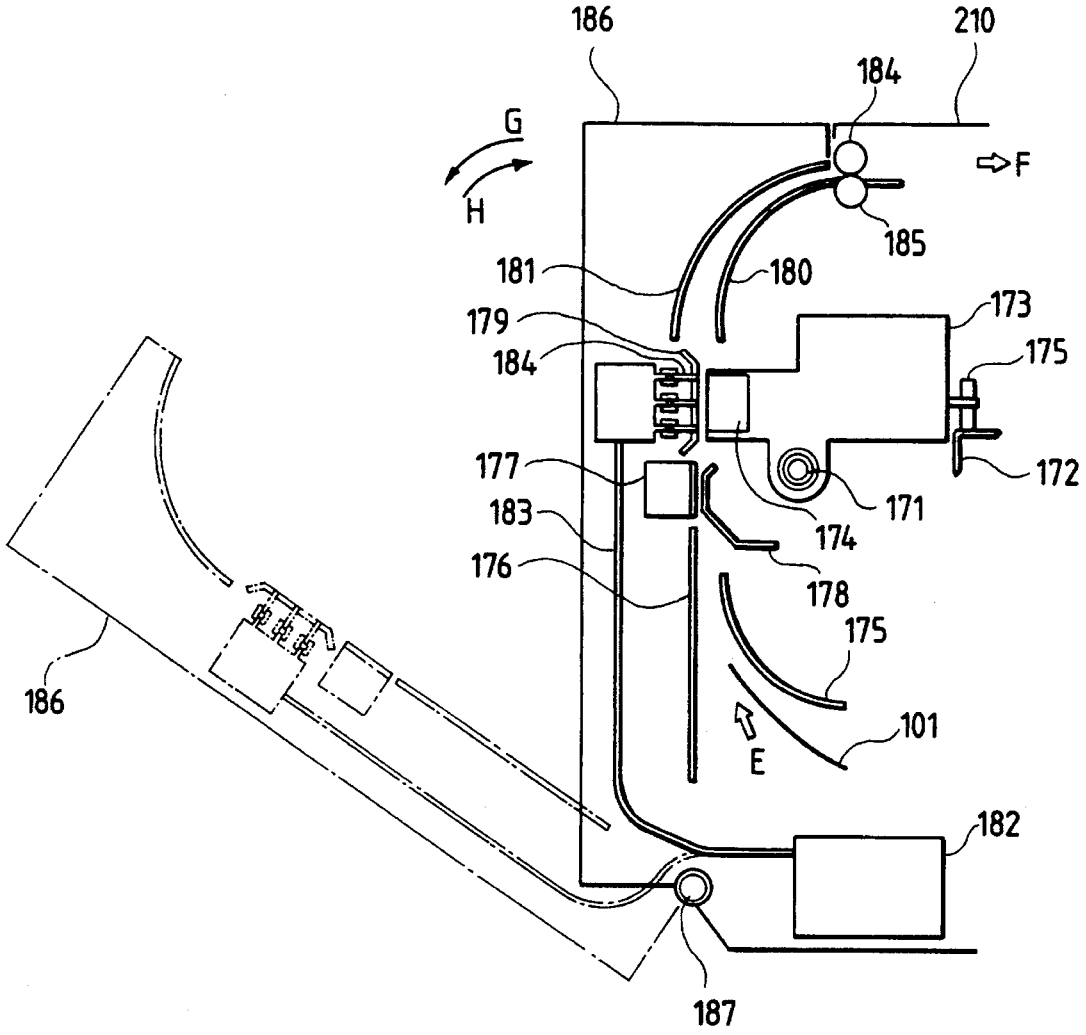
FIG. 11 is a schematic constructural view showing an image recording apparatus according to a fourth embodiment of the present invention.
Figure 12:
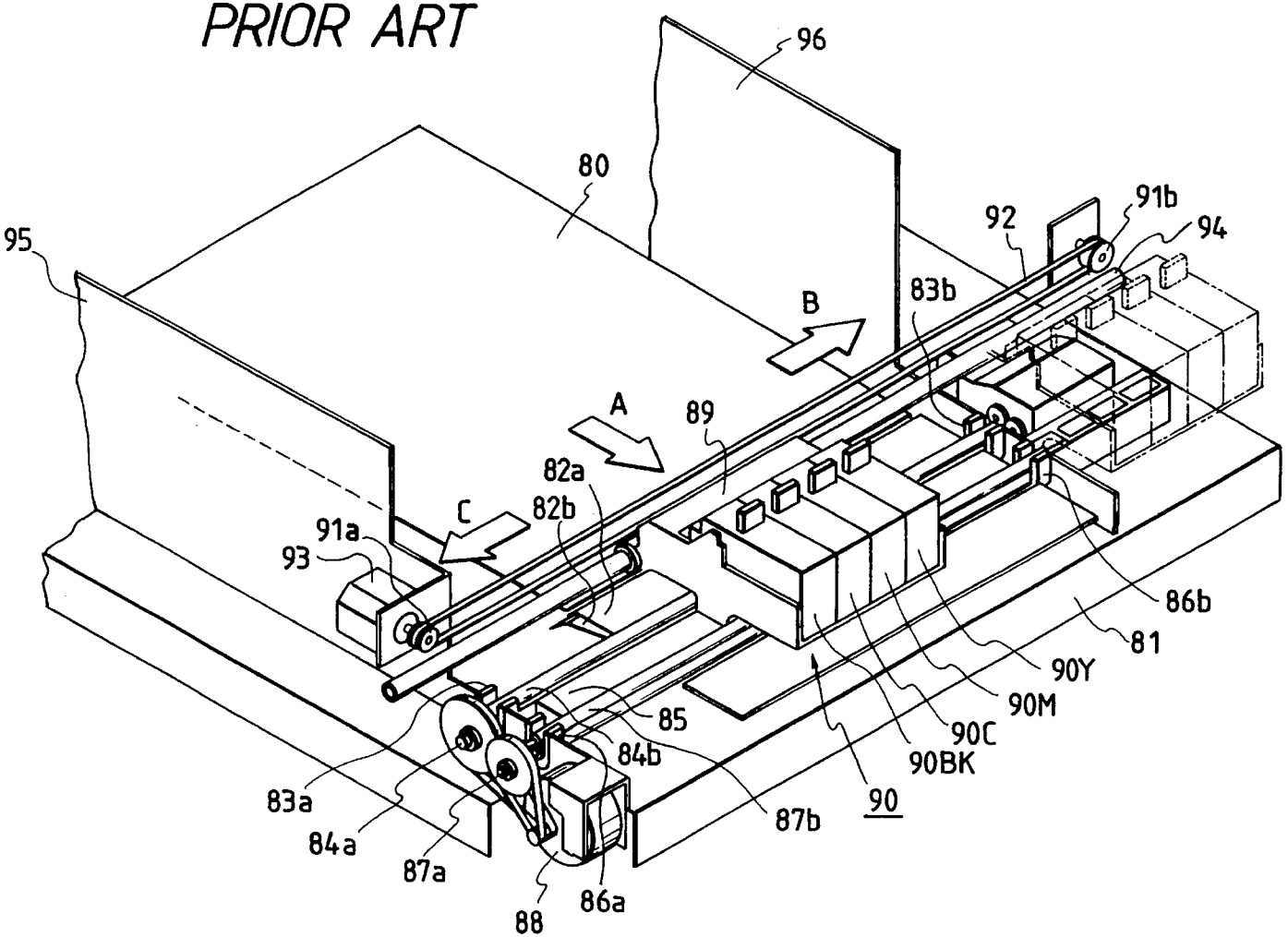
FIG. 12 PRIOR ART
FIG. 12 is a perspective view of a conventional recording apparatus.

FIG. 11 is a sectional view showing a fourth embodiment of the present invention wherein a conveying means can be mounted and dismounted with respect to the apparatus by rotating the former, and only shows main elements.

A carriage 173 is slidably supported by a main scanning rail 171 passing through the carriage. The carriage is also supported on an auxiliary rail 172 via a roller 175 rotatably mounted on the carriage, so that the carriage can be shifted along an axial direction of the main scanning rail 172. The carriage 173 incorporates therein ink tanks which can discharge ink dots toward a platen 179 through corresponding ink jet heads 174 in response to the discharge signals supplied from the control portion of the apparatus. Inner and outer sheet supply guides 175, 176 serve to guide the recording sheet 101 supplied from below toward a direction shown by the arrow E to a recording station. At the recording station, there is arranged a supersonic vibration conveying means 177 having a supersonic vibrator and adapted to receive a drive signal from the control portion of the apparatus to apply the vibration from the supersonic vibrator to the recording sheet 101 as a uni-directional advancing wave, which supersonic vibration conveying means can be contacted with the recording sheet 101. In this way, the recording sheet 101 can be moved upwardly.

An urging member 178 serves to effectively contact the recording sheet 101 with the supersonic vibration conveying means 177. When the ink is discharged from the ink jet head 174, the platen 179 supports the back surface of the recording sheet 101 to ensure the flatness of the sheet. A plurality of fine suction openings 184 are formed in the platen 179, which openings are connected to a vaccum pump 182 via a tube 183. The vacuum pump 182 operates to generate the negative pressure (with respect to the atmosphere) and serves to suck the recording sheet 101 toward the platen 179 (when the recording sheet 101 is positioned on the platen 179), thus ensuring the flatness of the recording sheet. Inner and outer ejection guides 180, 181 serve to guide the recorded sheet from the recording station to ejector rollers 184, 185 in a direction shown by the arrow F. The outer sheet supply guide 176, supersonic vibration conveying means 177, platen 179 and outer ejection guide 181 are integrally assembled on a rotatable base 186 which can be rotated around a pivot pin 187 in directions G and H to be dismounted and mounted with respect to the apparatus 210.

With this arrangement, since a sheet feeding path for the recording sheet 101 is divided (into two) in a direction perpendicular to the trace plane of the feeding movement of the recording sheet 101 in response to the dismounting operation of the conveying means, only by dismounting the conveying means, the position of the recording sheet 101 can easily be ascertained and the operator's finger can easily be inserted, thus removing the jammed recording sheet 101 easily.

What is claimed is:

1. A recording apparatus comprising:

recording means for recording an image on a sheet positioned at a predetermined recording position;

a pair of rotary members disposed adjacent to said recording means for nipping and conveying the sheet to pass through the recording position;

supporting means for supporting both of said paired rotary members;

shifting means for shifting said supporting means, together with both of said pair of rotary members, in a first direction away from said recording means and in a second direction different from the first direction and externally of said recording apparatus; and separating means for separating said pair of rotary members away from each other when said shifting means shifts said supporting means.

2. A recording apparatus according to claim 1, wherein said recording means comprises an ink jet head for discharging ink.

3. A recording apparatus according to claim 2, wherein said ink jet head discharges the ink by utilizing thermal energy.

4. A recording apparatus according to claim 1, wherein said pair of rotary members comprises a pair of rollers for pinching and conveying the sheet.

5. A recording apparatus according to claim 4, wherein said separating means separates said pair of rotary members from each other when said supporting means is shifted in the first direction.

6. A recording apparatus according to claim 1, wherein said pair of rotary members is arranged below said recording means, and said supporting means supports said pair of rotary members so that said pair of rotary members can be shifted horizontally after being shifted downwardly when said shifting means shifts said supporting means.

7. A recording apparatus according to claim 1, further including preventing means for preventing said pair of rotary members from shifting in a direction opposite to a direction of sheet thickness when said pair of rotary members is not positioned at a predetermined position where said pair of rotary members faces said recording means.

8. A recording apparatus comprising:

first and second containing means for containing sheets, respectively;

first sheet supplying means for feeding out the sheets from said first containing means, and second sheet supplying means for feeding out the sheets from said second containing means;

recording means positioned at a predetermined recording position for recording an image on a sheet fed from one of said first and second sheet supplying means;

a first sheet path for guiding the sheets fed by said first sheet supplying means to said recording means, and a second sheet path for guiding the sheets fed by said second sheet supplying means to said recording means, said first sheet path having an openable guide for guiding the sheet and for opening said first sheet path from a closed state;

conveying means disposed adjacent to said recording means for conveying the sheet fed by one of said first and second sheet supplying means so that the sheet passes through the recording position; and shifting means for shifting said conveying means and said openable guide to open said first sheet path.

9. A recording apparatus according to claim 8, further comprising means for shifting said first and second containing means in a direction transverse to the sheet feeding direction.

10. A recording apparatus according to claim 8, wherein said recording means comprises an ink jet head for discharging ink.

11. A recording apparatus according to claim 10, wherein said ink jet head discharges ink droplets by utilizing thermal energy.

12. A recording apparatus according to claim 8, wherein said conveying means comprises a pair of rollers for pinching and conveying the sheet.

13. A recording apparatus according to claim 8, wherein said shifting means comprises guide rail means for slidably supporting said conveying means.

14. A recording apparatus according to claim 13, wherein said guide rail means is disposed between said first and second containing means.

15. A recording apparatus comprising:

a pair of rotary members for nipping a sheet to convey the sheet;

recording means for effecting recording on the sheet conveyed by said pair of rotary members;

supporting means for supporting said pair of rotary members;

shifting means for shifting said supporting means, together with said pair of rotary members, in a direction away from said recording means; and separating means for separating said pair of rotary members away from each other when said shifting means shifts said supporting means.

16. A recording apparatus according to claim 15, wherein said recording means comprises an ink jet head for discharging ink therefrom.

17. A recording apparatus according to claim 16, wherein said ink jet head discharges ink droplets using thermal energy.

18. A sheet conveying apparatus comprising:

a guide for guiding a sheet along a convey path, said guide being shiftable to open the convey path from a closed state;

a pair of rotary members for nipping the sheet guided by said guide and conveying the sheet;

a support member for supporting both of said pair of rotary members;

shifting means for shifting said guide and said support member for opening the convey path; and separating means for separating said pair of rotary member away from each other when said shifting means shifts said support member.

* * * * *

UNITED STATES PATENT AND TRADEMARK OFFICE

CERTIFICATE OF CORRECTION

PATENT NO. : 5,517,226

DATED : May 14, 1996

INVENTOR(S) : Tsukasa UEHARA, et al.

It is certified that error appears in the above-indentified patent and that said Letters Patent is hereby corrected as shown below:

Title page, col. 2, line 10,

AT [56] REFERENCES CITED - U.S. PATENT DOCUMENTS:

"4,729,683 3/1988 Zewski" should read --4,729,683 3/1988 Staniszewski--; and

"4,848,995 7/1989 Sone" should read --4,848,945 7/1989 Sone--.

COLUMN 2:

Line 32, "touched" should read --would touch--.

COLUMN 16:

Line 8, "abnormity" should read --abnormality--.

Signed and Sealed this

Tenth Day of September, 1996

*Attest:*

BRUCE LEHMAN

*Attesting Officer*

*Commissioner of Patents and Trademarks*